US007388325B2

(12) United States Patent
Kato et al.

(10) Patent No.: US 7,388,325 B2
(45) Date of Patent: Jun. 17, 2008

(54) FLAT DISPLAY DEVICE

(75) Inventors: Yoshimitsu Kato, Kanagawa (JP); Satoshi Okanan, Gifu (JP); Keiji Honda, Aichi (JP); Masaru Kokubukata, Gifu (JP); Hiroshi Sata, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/552,443

(22) Filed: Oct. 24, 2006

(65) Prior Publication Data

US 2007/0096623 A1 May 3, 2007

(30) Foreign Application Priority Data

Oct. 26, 2005 (JP) ..... P2005-310657

(51) Int. Cl.
*H01J 63/04* (2006.01)
*H01J 1/62* (2006.01)

(52) U.S. Cl. ..... 313/496; 313/309; 313/336; 313/351; 313/352

(58) Field of Classification Search ..... 313/496
See application file for complete search history.

(56) References Cited

U.S. PATENT DOCUMENTS 5,395,738 A * 3/1995 Brandes et al. ..... 430/296
5,639,330 A 6/1997 Otake et al.
6,879,096 B1 * 4/2005 Miyazaki et al. ..... 313/495
7,138,760 B2 * 11/2006 Kim ..... 313/497
7,166,956 B2 1/2007 Ito et al.
2001/0028215 A1 * 10/2001 Kim ..... 313/495
2003/0152801 A1 * 8/2003 Liao et al. ..... 428/690
2005/0218788 A1 * 10/2005 Jang et al. ..... 313/497

FOREIGN PATENT DOCUMENTS

| | | |
|---|---|---|
| JP | 10-321169 | 12/1998 |
| JP | 2004-500688 | 1/2004 |
| JP | 2004-152438 | 5/2004 |
| WO | 01/56050 | 8/2001 |

* cited by examiner

*Primary Examiner*—Ashok Patel
(74) *Attorney, Agent, or Firm*—Bell, Boyd & Lloyd LLP

(57) ABSTRACT

A flat-type display device is provided. The flat-type panel display includes a cathode panel having a plurality of electron emitter areas formed on a support; and an anode panel having formed on a substrate a plurality of fluorescent regions and an anode electrode covering at least the fluorescent regions, in which the cathode panel and the anode panel are joined together at their edges with a joint member in between. In the display device, the anode panel has formed on the anode electrode an electron absorbing layer for absorbing electrons from any one of the fluorescent regions and the anode electrode or both, and the anode panel has an adhesion improving layer formed between the anode electrode and the electron absorbing layer.

9 Claims, 12 Drawing Sheets

FLAT DISPLAY DEVICE

CROSS REFERENCES TO RELATED APPLICATION

The present application claims priority to Japanese Patent Application JP 2005-310657 filed in the Japanese Patent Office on Oct. 26, 2005, the entire contents of which being incorporated herein by reference.

BACKGROUND

The present disclosure relates to a flat-type display device. As image display devices which will possibly replace cathode-ray tubes (CRTs) currently widely spread, flat (flat panel type) display devices are vigorously studied. Examples of the flat display devices include a liquid crystal display (LCD), an electroluminescence display (ELD), and a plasma display (PDP). In addition, flat display devices having incorporated therein a cathode panel having an electron emission device are also developed. As electron emission devices, a cold cathode field emission device, a metal/insulating film/metal element (also called an MIM element), and a surface conductive-type electron emission device are known, and a flat display device having incorporated therein a cathode panel having the above electron emission device composed of a cold cathode electron source has attracted attention since it advantageously achieves color display with high resolution and high luminance and causes low power consumption.

A cold cathode field emission display device (hereinafter, frequently referred to simply as "display device") is a flat display device having incorporated therein a cold cathode field emission device as an electron emission device. This type of display device generally has a structure having a cathode panel CP and an anode panel AP disposed so that they face each other through a high-vacuum space, and joined together at their edges through a joint member. The cathode panel CP has a plurality of cold cathode field emitter elements (hereinafter, frequently referred to simply as "field emitter element(s)"), and the anode panel AP has a fluorescent region with which electrons emitted from the field emitter elements collide and which are excited to emit light. The cathode panel CP has electron emitter areas arrayed in a two-dimensional matrix form and corresponding to respective subpixels, wherein each electron emitter area has formed one or a plurality of field emission devices. Examples of field emitter elements include those of Spindt type, flattened type, edge type, or flat type.

A schematic fragmentary end view of a display device having a Spindt-type field emission device as an example is shown in FIG. 10, and a partial, schematic exploded perspective view of a cathode panel CP and an anode panel AP separated from each other is shown in FIG. 12. The Spindt-type field emission device constituting the display device includes a cathode electrode 11, an insulating layer 12, a gate electrode 13, openings 14, and a conical electron emitter 15. Herein, the cathode electrode 11 is formed on a support 10. The insulating layer 12 is formed on the support 10 and the cathode electrode 11. The gate electrode 13 is formed on the insulating layer 12. The openings 14 are formed in the gate electrode 13 and insulating layer 12, in which a first opening 14A formed in the gate electrode 13 and a second opening 14B formed in the insulating layer 12. The conical electron emitter 15 is formed on the cathode electrode 11 at the bottom of each opening 14.

A schematic fragmentary end view of a display device having a so-called flattened field emission device having a substantially planar electron emitter 15A is shown in FIG. 11. This field emission device is similar to the Spindt-type field emission device as described above, and is different in having an electron emitter 15A formed on the cathode electrode 11 at the bottom of each opening 14, instead of the electron emitter 15. The electron emitter 15A is composed of, for example, a number of carbon nanotubes, part of which is buried in the matrix.

In these display devices, the cathode electrode 11 is in the form of a strip extending in a first direction (corresponding to the X direction shown in the figures), and the gate electrode 13 is in the form of a strip extending in a second direction (corresponding to the Y direction shown in the figures) different from the first direction (X direction). Generally, the cathode electrode 11 and the gate electrode 13 are formed in strips in respective directions such that the images from the electrodes 11, 13 cross at a right angle. An area where the strip-form cathode electrode 11 and the strip-form gate electrode 13 overlap is an electron emitter area EA, and corresponds to one subpixel. The electron emitter areas EA are generally arrayed in a two-dimensional matrix form in an effective region of the cathode panel CP. The effective region herein means a display area at the center having a practical function of the flat display device, i.e., display function, wherein an ineffective region is present on the outside of the effective region and in the form of a frame surrounding the effective region.

On the other hand, the anode panel AP has a structure including fluorescent regions 22 having a predetermined pattern formed on a substrate 20 wherein the fluorescent regions 22 are covered with an anode electrode 24. The fluorescent regions 22 include, specifically, a red light-emitting fluorescent region 22R, a green light-emitting fluorescent region 22G, and a blue light-emitting fluorescent region 22B. A light absorbing layer (black matrix) 23 composed of a light absorbing material, such as carbon, is buried between the fluorescent regions 22 to prevent the occurrence of color mixing in the display image, optical cross talk. The barrier 21 has a flat form of lattice-like form, that is, form of parallel crosses, surrounding one subpixel or a fluorescent region. In the figure, a reference numeral 40 designates a spacer, a reference numeral 25 designates a spacer holder, a reference numeral 26 designates a joint member, a reference numeral 17 designates a focusing electrode, and a reference numeral 16 designates an inter-layer dielectric layer. In FIGS. 11 and 12, the barrier, spacer, spacer holder, and focusing electrode are not shown.

One subpixel is composed of the electron emitter area EA on the cathode panel side, and the fluorescent region 22 on the anode panel side opposite (facing) the above electron emitter area EA. The pixels on the order of, e.g., several hundred thousand to several million are arrayed in the effective region. In the display device making color display, one pixel is composed of an assembly of a red light-emitting subpixel, a green light-emitting subpixel, and a blue light-emitting subpixel.

The electrons emitted from the electron emitter areas EA collide with the anode electrode 24 and pass through the anode electrode 24, and collide with the fluorescent regions 22, so that the fluorescent regions 22 are excited to emit light. Part of the electrons, which have collided with the anode electrode 24 or fluorescent regions 22, bounce in the direction from the anode panel AP to the cathode panel CP. Further, the collision of the electrons with the fluorescent regions 22 causes the fluorescent regions 22 to emit secondary electrons in the direction to the cathode panel CP. The bouncing electrons and the secondary electrons are collectively referred to as "backscattering electrons".

By the way, it is known that, with respect to the lowering of the contrast due to the backscattering electrons on the cold cathode field emission display device is remarkable, as compared to a case of a cathode-ray tube. Specifically, backscattering electrons collide with, for example, the adjacent fluorescent region to cause light emission from an undesired fluorescent region, thus lowering the contrast. Examples of reasons that such a phenomenon is likely to occur in the cold cathode field emission display device include:

(1) a fact that the potential gradient in the space between the anode panel AP and the cathode panel CP is as large as about 20 to 70 times that in the cathode-ray tube;

(2) a fact that irradiation of electrons to the fluorescent regions is conducted in a linear sequential mode, and therefore a period of time during which the electrons collide with the fluorescent regions is long, namely, the total number of electrons which collide with the fluorescent regions is large and, consequently, the absolute value of backscattering electrons is large; and (3) a fact that the cold cathode field emission display device does not have a color identification mechanism which contributes to absorption of the scattering electrons and which is inherent in a cathode-ray tube that has been subjected to surface treatment, for example, oxide film treatment.

A technique for avoiding the adverse effect of the backscattering electrons, in which, for example, a carbon layer is formed on the anode electrode composed of, e.g., an aluminum layer, has been disclosed in Japanese Patent Application Publication (KOKAI) No. Hei 10-321169. The carbon layer has a lower scattering coefficient for primary electrons than that of the aluminum layer, and hence it is believed that the carbon layer reduces the number of electrons which enter the fluorescent regions to scatter.

However, this technique has the following problem. After the carbon layer is formed on the anode electrode composed of an aluminum layer, the anode panel having the carbon layer is processed through various thermal steps. The carbon layer is adversely affected by heat shrinkage due to heating and cooling or the heating atmosphere in the thermal steps, so that the carbon layer is partially or completely peeled off the aluminum layer or a crack is caused in the carbon layer. Such a phenomenon results in particles or a sharp portion on the carbon layer, so that the application of a high voltage to the anode electrode induces discharge, thus lowering the reliability or shortening the life of the display device.

Additional features and advantages are described herein, and will be apparent from, the following Detailed Description and the figures.

SUMMARY

Accordingly, in view of the above-mentioned problems, the present disclosure provides a flat-type display device having a structure or construction where the anode panel is prevented from suffering damage in thermal steps.

A flat-type display device according to an embodiment is a flat-type display device which comprises: a cathode panel having a plurality of electron emitter areas formed on a support; and an anode panel having formed on a substrate a plurality of fluorescent regions and an anode electrode covering at least the fluorescent regions, in which the cathode panel and the anode panel are joined together at their edges through a joint member. In the device, the anode panel has formed on the anode electrode an electron absorbing layer for absorbing electrons from any one of the fluorescent regions and the anode electrode or both, and the anode panel has an adhesion improving layer formed between the anode electrode and the electron absorbing layer.

In the flat-type display device of the embodiment, it may be configured so that the anode panel has formed on the substrate a barrier in a lattice-like pattern surrounding each fluorescent region, the anode electrode covers each fluorescent region and extends to the sidewall of the barrier, and the adhesion improving layer and the electron absorbing layer are formed on the top surface of the barrier. The barrier is formed for preventing the electrons bouncing off the fluorescent regions or the secondary electrons emitted from the fluorescent regions from entering other fluorescent regions to cause unnecessary light emission from the undesired fluorescent regions, i.e., so-called optical crosstalk (color mixing).

In the above flat-type display device of the embodiment, it is preferable that the electron absorbing layer is composed mainly of an atom having an atomic number smaller than that of the atom mainly constituting the anode electrode, or composed of a material having conductivity and having a coefficient of secondary electron emission smaller than that of the material constituting the anode electrode, for example, a carbon material or boron material. More specifically, the electron absorbing layer is preferably composed of carbon, but the material constituting the electron absorbing layer is not limited to carbon, and another example may include boron carbide and boron nitride. It is desirable that the electron absorbing layer has a larger average thickness from a viewpoint of achieving effective absorption of electrons, and it is desirable that the electron absorbing layer has a smaller average thickness from a viewpoint of improving the flat-type display device in luminance, and the average thickness of the electron absorbing layer may be, for example, $5\times10^{-8}$ m to $3\times10^{-7}$ m, preferably $7\times10^{-8}$ m to $1.5\times10^{-7}$ m.

Examples of methods for forming the electron absorbing layer may include various physical vapor deposition processes (PVD processes), such as deposition processes, e.g., an electron beam deposition process and a hot filament deposition process, a sputtering process, an ion plating process, and a laser ablation process; various chemical vapor deposition processes (CVD processes); a screen printing process; a metal mask printing process; and a coating process using a roll coater.

In the above-mentioned flat-type display device of the embodiment, it is preferred that the adhesion improving layer is composed of a silicon carbide layer, a layer composed of silicon carbide and boron carbide (e.g., a layer made of silicon carbide of wt 75% or more and less than 100 wt % and boron carbide of more than 0 wt % and 25 wt % or less), or a tungsten carbide layer. In a case where the adhesion improving layer is composed of a silicon carbide layer, it is preferred that it is composed of a carbon-rich silicon carbide layer (specifically, containing carbon in an amount of more than 50 mol %, preferably 80 mol % or more). It is desirable that the adhesion improving layer has a larger average thickness from the viewpoint of improving the adhesion and securing satisfactory strength of the adhesion improving layer, and it is desired that the adhesion improving layer has a smaller average thickness from the viewpoint of improving the flat-type display device in luminance, and the average thickness of the adhesion improving layer may be, for example, $1\times10^{-8}$ m to $3\times10^{-7}$ m, preferably $2\times10^{-8}$ m to $2\times10^{-7}$ m.

Examples of methods for forming the adhesion improving layer include various PVD processes, such as deposition processes, e.g., an electron beam deposition process and a hot filament deposition process, a sputtering process, an ion plating process, and a laser ablation process; various CVD processes; a screen printing process; a metal mask printing process; and a coating process using a roll coater. From the viewpoint of improving the adhesion of the adhesion improving layer to the anode electrode, it is preferred that, prior to formation of the adhesion improving layer, the surface of the anode electrode is subjected to a kind of cleaning treatment to remove oxide films formed on the anode electrode surface or organic substances and the like deposited on the anode electrode surface. Examples of cleaning treatments include a plasma treatment and a UV ozone treatment.

Examples of materials constituting the anode electrode include metals, such as aluminum (Al), molybdenum (Mo), chromium (Cr), tungsten (W), niobium (Nb), tantalum (Ta), gold (Au), silver (Ag), titanium (Ti), cobalt (Co), zirconium (Zr), iron (Fe), platinum (Pt), and zinc (Zn); alloys or compounds containing the above metal element (e.g., nitrides, such as TiN, and silicides, such as $WSi_2$, $MoSi_2$, $TiSi_2$, and $TaSi_2$); semiconductors, such as silicon (Si); carbon thin films of diamond or the like; and conductive metal oxides, such as ITO (indium-tin oxide), indium oxide, and zinc oxide.

Examples of methods for forming the anode electrode include various PVD processes, such as deposition processes, e.g., an electron beam deposition process and a hot filament deposition process, a sputtering process, an ion plating process, and a laser ablation process; various CVD processes; a screen printing process; a metal mask printing process; a lift-off process; and a sol-gel process. Specifically, the anode electrode can be formed by forming a conductor layer composed of a conductor and patterning the conductor layer in accordance with a lithography technique and an etching technique. Alternatively, the anode electrode can be obtained by forming a conductor layer through a mask or screen having a pattern of the anode electrode by a PVD process or a screen printing process. The average thickness of the anode electrode on the substrate (or at the upper portion of the substrate) may range, for example, from $3\times10^{-8}$ m (30 nm) to $5\times10^{-7}$ m (0.5 μm), preferably from $5\times10^{-8}$ m (50 nm) to $3\times10^{-7}$ m (0.3 μm).

The anode electrode may be configured with either a single anode electrode as a whole or a plurality of anode electrode units. In the latter, it is desirable that one anode electrode unit is electrically connected to another anode electrode unit through an anode electrode resistance layer. It is preferable that the adhesion improving layer serves also as an anode electrode resistance layer. The adhesion improving layer as an anode electrode resistance layer may have a sheet resistance ranging, for example, from $1\times10^{-1}$ Ω/□ to $1\times10^{10}$ Ω/□, preferably $1\times10^{3}$ Ω/□ to $1\times10^{8}$ Ω/□. The number (Q) of the anode electrode units may be 2 or more. For example, when the total number of rows of the fluorescent regions arrayed in a straight line is q, Q=q, or q=k●Q (wherein k is an integer of 2 or more, preferably $10\leqq k\leqq100$, more preferably $20\leqq k\leqq50$), or Q may be a value obtained by adding one (1) to the number of spacers disposed at predetermined intervals, a value equal to the number of pixels or subpixels, or a value obtained by dividing the number of pixels or subpixels by an integer. The sizes of the individual anode electrode units may be either the same irrespective of the positions of the anode electrode units or different depending on the positions of the anode electrode units. If, instead of the anode electrode formed on the almost entire effective region, individual anode electrode units each having a smaller area are formed as mentioned above, it is possible to reduce the electrostatic capacity between the anode electrode unit and the electron emitter area. As a result, the occurrence of discharge can be suppressed and hence the anode electrode or electron emitter area can be effectively prevented from suffering damage due to discharge.

In a case where the anode electrode is composed of anode electrode units and the barrier is formed, the anode electrode units can be formed over each fluorescent region and the sidewall of the barrier. The anode electrode units may be formed over each fluorescent region and part of the sidewall of the barrier. In this case, the adhesion improving layer is formed over the top surface of the barrier and the anode electrode units, namely, formed on the entire surface, and the electron absorbing layer is formed on the adhesion improving layer.

The fluorescent regions may be composed of either fluorescent particles of single color or fluorescent particles of three primary colors. The array form of the fluorescent regions is, for example, dotted. Specifically, in a case where the flat-type display device makes color display, examples of array forms of the fluorescent regions include a delta array, a striped array, a diagonal array, and a rectangle array. That is, one row of the fluorescent regions arrayed in a straight line may be either configured with a row occupied only by red light-emitting fluorescent regions, a row occupied only by green light-emitting fluorescent regions, or a row occupied only by blue light-emitting fluorescent regions or configured with a row composed of red light-emitting fluorescent regions, green light-emitting fluorescent regions, and blue light-emitting fluorescent regions, which are successively arranged. In the present specification, the fluorescent region is defined as a fluorescent region producing one luminescent spot on the anode panel. One pixel is composed of an assembly of one red light-emitting fluorescent region, one green light-emitting fluorescent region, and one blue light-emitting fluorescent region, and one subpixel is composed of one fluorescent region (one red light-emitting fluorescent region, one green light-emitting fluorescent region, or one blue light-emitting fluorescent region). Gaps between the adjacent fluorescent regions may be plugged with a light absorbing layer (black matrix) for improving the contrast.

The fluorescent regions can be formed by a method in which, using a luminescent crystal particle composition prepared from luminescent crystal particles, for example, a photosensitive, red luminescent crystal particle composition (red fluorescent slurry) is applied to the entire surface, and exposed and developed to form a red light-emitting fluorescent region, and then a photosensitive, green luminescent crystal particle composition (green fluorescent slurry) is applied to the entire surface, and exposed and developed to form a green light-emitting fluorescent region, and further a photosensitive, blue luminescent crystal particle composition (blue fluorescent slurry) is applied to the entire surface, and exposed and developed to form a blue light-emitting fluorescent region. Alternatively, each fluorescent region may be formed by a method in which a red light-emitting fluorescent paste, a green light-emitting fluorescent paste, and a blue light-emitting fluorescent paste are successively applied in an arbitrary pattern and then the individual fluorescent paste applied regions are successively exposed and developed, or each fluorescent region may be formed by a screen printing process, an ink-jet process, a floating knife coating process, a sedimentation coating process, a fluorescent film transfer process, or the like. With respect to the average thickness of the fluorescent regions on the substrate, there is no particular limitation, but it is desired that the average thickness is 3 to 20 μm, preferably 5 μm to 10 μm. The fluorescent material constituting the luminescent crystal particles can be appropriately selected from conventionally known fluorescent materials. For color display, a combination of fluorescent materials which have color purity close to those of the three primary colors defined in NTSC is preferred, whose three primary colors are mixed to have excellent white balance and the three primary colors individually have substantially the same and short afterglow time.

It is preferable that a light absorbing layer for absorbing light from the fluorescent regions is formed between the adjacent fluorescent regions or between the barrier and the substrate from the viewpoint of improving the contrast of the display image. The light absorbing layer serves as a so-called black matrix. As a material constituting the light absorbing layer, a material capable of absorbing 99% or more of light from the fluorescent regions is preferably selected. Examples of the materials include carbon, metal thin films (e.g., chromium, nickel, aluminum, molybdenum, and alloys thereof), metal oxides (e.g., chromium oxide), metal nitrides (e.g., chromium nitride), heat-resistant organic resins, glass pastes, and glass pastes containing a black pigment or conductive particles of silver or the like, and specific examples include photosensitive polyimide resins, chromium oxide, and a chromium oxide/chromium stacked film. In the chromium oxide/chromium stacked film, the chromium film is in contact with the substrate. The light absorbing layer can be formed by a method appropriately selected depending on the material used, for example, a combination of a vacuum vapor deposition process or a sputtering process and an etching process, a combination of a vacuum vapor deposition process, a sputtering process, or a spin coating process and a lift-off process, a screen printing process, or a lithography technique.

Examples of methods for forming the barrier in a lattice-like pattern include a screen printing process, a dry film process, a photosensitive process, a casting process, and a sandblasting forming process. The screen printing process is a method in which a barrier-forming material is put on a screen having openings formed in portions corresponding to the positions where barriers should be formed, and the material is allowed to pass through the openings of the screen using a squeegee to form a barrier-forming material layer on a substrate, followed by calcination of the barrier-forming material layer. The dry film process is a method in which a photosensitive film is laminated on a substrate, and portions of the photosensitive film where barriers will be formed are removed by exposure and development, and openings resulting from the removal of the film are plugged with a barrier-forming material, followed by calcination. The photosensitive film is burned and removed by calcination, and the barrier-forming material in the openings remains to form barriers. The photosensitive process is a method in which a barrier-forming material layer having photosensitivity is formed on a substrate, and the barrier-forming material layer is patterned by exposure and development, followed by calcination (curing). The casting process is a method in which a barrier-forming material composed of an organic material or inorganic material in the form of a paste is casted from a cast onto a substrate to form a barrier-forming material layer, followed by calcination of the barrier-forming material layer. The sandblasting forming process is a method in which a barrier-forming material layer is formed on a substrate by, for example, a screen printing or a metal mask printing process, or using a roll coater, a doctor blade, or a nozzle injection coater, and dried and then, portions of the barrier-forming material layer where barriers will be formed are covered with a mask layer, and then the exposed portions of the barrier-forming material layer are removed by a sandblasting method. After being formed, the barriers may be polished to planarize the top surfaces of the barriers.

Examples of materials for forming the barrier include photosensitive polyimide resins, and lead glass, $SiO_2$, and low melting-point glass pastes colored black with a metal oxide, such as cobalt oxide. On the surface (top surface and sidewall) of the barrier may be formed a protective layer (composed of, e.g., $SiO_2$, SiON, or AlN) for preventing an electron beam from colliding with the barrier to release gas from the barrier.

Examples of flat forms of the portion of the lattice-like barrier surrounding each fluorescent region (corresponding to the inner contour of the image from the sidewall of the barrier, which is a kind of opening region) include a rectangular form, a circular form, an elliptical form, an oblong form, a triangular form, a polygonal form having five sides or more, a rounded triangular form, a rounded rectangular form, and a rounded polygonal form. These flat forms (flat forms of the opening regions) are arrayed in a two-dimensional matrix form to form a barrier in a lattice-like pattern. This array in a two-dimensional matrix form may be, for example, either a form of parallel crosses or a zigzag form.

In the manufacture of the flat-type display device of an embodiment, it is preferred that, prior to formation of the conductor layer constituting the anode electrode, a resin layer is formed on the fluorescent regions and a conductor layer is formed on the resin layer, followed by heat treatment, thereby removing the resin layer. By virtue of the resin layer thus formed, not only can the resin layer protect the fluorescent regions to prevent the fluorescent regions from suffering damage in various steps of the process for producing the anode panel, but also the portion of the anode electrode on the fluorescent regions can be a mirror surface.

Examples of materials constituting the resin layer include a lacquer and an aqueous solution of polyvinyl alcohol (PVA). The lacquer includes a kind of varnish in a broad sense, which is obtained by dissolving a composition composed mainly of a cellulose derivative, generally nitrocellulose in a volatile solvent, such as a lower fatty acid ester, an urethane lacquer or acrylic lacquer using another synthetic polymer, and a lacquer containing a chromium compound or a manganese compound. The aqueous solution of polyvinyl alcohol includes a diluted aqueous solution having a drying speed controlled by adding a glycol solvent and glycerol, and an aqueous solution containing a chromium compound or a manganese compound. Examples of methods for forming the resin layer include a screen printing process; a metal mask printing process; a coating process using a roll coater, a spray coater, or a transfer method; and a lacquer floating process. Herein, the lacquer floating process is a process in which a substrate is placed in water contained in a water bath and a resin layer is formed on the water surface, and then the water is removed to permit the resin layer to be deposited on the substrate. The resin layer is removed by a heat treatment, specifically, the resin layer may be burned (decomposed) by a heat treatment at, for example, a temperature at which the resin layer can be burned.

In the flat-type display devices as described above, examples of substrates constituting the anode panel or supports constituting the cathode panel include a glass substrate, a glass substrate having an insulating film formed on its surface, a quartz substrate, a quartz substrate having an insulating film formed on its surface, and a semiconductor substrate having an insulating film formed on its surface, but, from the viewpoint of reducing the manufacturing cost, a glass substrate or a glass substrate having an insulating film formed on its surface is preferably used. Examples of glass substrates include high distortion-point glass, soda glass ($Na_2O$●$CaO$●$SiO_2$), borosilicate glass ($Na_2O$●$B_2O_3$●$SiO_2$), forsterite ($2MgO$●$SiO_2$), lead glass ($Na_2O$●$PbO$●$SiO_2$), and non-alkali glass.

In the flat-type display device according to an embodiment, examples of electron emitter elements constituting the electron emitter areas include a cold cathode field emitter element (hereinafter, referred to simply as "field emitter element"), a metal/insulating film/metal element (MIM element), and a surface conductive-type electron emitter element. Examples of the flat-type display devices include a flat-type display device having a cold cathode field emitter element (cold cathode field emission display device), a flat-type display device having incorporated an MIM element, and a flat-type display device having incorporated a surface conductive-type electron emitter element.

In the cold cathode field emission display device, a strong electric field resulting from the application of a voltage across the cathode electrode and the gate electrode is applied to the electron emitter, so that electrons are emitted from the electron emitter due to a quantum tunnel effect. The electrons are attracted by the anode panel due to the anode electrode in the anode panel, and collide with the fluorescent regions. The collision of the electrons with the fluorescent regions causes the fluorescent regions to emit light, which can be recognized as an image.

In the cold cathode field emission display device, the cathode electrode is connected to a cathode electrode control circuit, the gate electrode is connected to a gate electrode control circuit, and the anode electrode is connected to an anode electrode control circuit. These control circuits can be configured with a known circuit. In an actual operation, an output voltage $V_A$ of the anode electrode control circuit is generally constant, and can be, for example, 5 kV to 15 kV. It is desired that a $V_A/d_0$ (unit: kV/mm) value is 0.5 to 20, preferably 1 to 10, more preferably 4 to 8 where $d_0$ is a distance between the anode panel and the cathode panel (where $0.5\ mm \leqq d_0 \leqq 10\ mm$). In an actual operation of the cold cathode field emission display device, with respect to the voltage $V_C$ applied to the cathode electrode and the voltage $V_G$ applied to the gate electrode, a voltage modulation mode can be used as a gray level control mode.

More specifically, the field emitter element, includes:

(a) a cathode electrode, formed on a support, in the form of a strip extending in a first direction;

(b) an insulating layer formed on the cathode electrode and the support;

(c) a gate electrode, formed on the insulating layer, in the form of a strip extending in a second direction different from the first direction;

(d) openings formed in portions of the gate electrode and insulating layer in an overlap portion where the cathode electrode and the gate electrode overlap, wherein the cathode electrode is exposed through the bottom of each opening; and (e) an electron emitter formed on the cathode electrode exposed through the bottom of each opening, and controlled in electron emission by the application of a voltage across the cathode electrode and the gate electrode.

With respect to the type of the field emitter element, there is no particular limitation, and examples include a Spindt-type field emitter element and a flattened-type field emitter element. The Spindt-type field emitter element is a field emitter element having a conical electron emitter formed on the cathode electrode at the bottom of each opening. The flattened-type field emitter element is a field emitter element having a substantially flat electron emitter formed on the cathode electrode at the bottom of each opening.

In the cathode panel, it is preferable that an image from the cathode electrode and an image from the gate electrode cross at a right angle, that is, the first direction and the second direction cross at a right angle from the viewpoint of achieving the cold cathode field emission display device having a simplified structure. Further, in the cathode panel, the overlap portion where the cathode electrode and the gate electrode overlap corresponds to the electron emitter area, and the electron emitter areas are arrayed in a two-dimensional matrix form, and each electron emitter area has one or a plurality of field emitter elements.

The field emitter element can be generally fabricated by a method including:

(1) forming a cathode electrode on a support;

(2) forming an insulating layer on the entire surface (on the support and the cathode electrode);

(3) forming a gate electrode on the insulating layer;

(4) forming openings in portions of the gate electrode and the insulating layer in an overlap portion between the cathode electrode and the gate electrode so that the cathode electrode is exposed through the bottom of each opening; and (5) forming an electron emitter on the cathode electrode at the bottom of each opening.

Alternatively, the field emitter element can be fabricated by the following method including:

(1) forming a cathode electrode on a support;

(2) forming an electron emitter on the cathode electrode;

(3) forming an insulating layer on the entire surface (on the support and the electron emitter, or on the support, the cathode electrode, and the electron emitter);

(4) forming a gate electrode on the insulating layer; and (5) forming openings in portions of the gate electrode and the insulating layer in an overlap portion between the cathode electrode and the gate electrode so that the electron emitter is exposed through the bottom of each opening.

The field emitter element may have a focusing electrode. Specifically, in the field emitter element, for example, a focusing electrode may be formed on an interlayer dielectric layer which is further formed on the gate electrode and the insulating layer, or a focusing electrode may be formed at an upper portion of the gate electrode. Herein, the focusing electrode is an electrode for focusing the track of electrons emitted from the openings toward the anode electrode to improve the luminance or to prevent optical cross talk between the adjacent pixels. In a so-called high voltage-type cold cathode field emission display device having a potential difference between the anode electrode and the cathode electrode on the order of several kV or more and having a relatively large distance between the anode electrode and the cathode electrode, the focusing electrode is especially effective. A relatively negative voltage (e.g., 0 V) is applied to the focusing electrode from a focusing electrode control circuit. The focusing electrode is not necessarily formed so that it individually surrounds each electron emitter or electron emitter area formed in the overlap region where the cathode electrode and the gate electrode overlap. However, for example, focusing electrodes may extend in a predetermined array direction of the electron emitters or the electron emitter areas, or a single focusing electrode may surround the all electron emitters or electron emitter areas. In other words, the focusing electrode may have a structure of one thin sheet covering the whole effective region which is a display region at the center having a practical function of the cold cathode field emission display device. Accordingly, this results in offering a focusing effect common to a plurality of field emitter elements or electron emitter areas.

On the surface of the focusing electrode may be formed a carbon layer for preventing gas release from the focusing electrode.

Examples of materials constituting the cathode electrode, gate electrode, or focusing electrode include various metals including transition metals, such as chromium (Cr), aluminum (Al), tungsten (W), niobium (Nb), tantalum (Ta), molybdenum (Mo), copper (Cu), gold (Au), silver (Ag), titanium (Ti), nickel (Ni), cobalt (Co), zirconium (Zr), iron (Fe), platinum (Pt), and zinc (Zn); alloys (e.g., MoW) or compounds containing the above metal element (e.g., nitrides, such as TiN, and suicides, such as $WSi_2$, $MoSi_2$, $TiSi_2$, and $TaSi_2$); semiconductors, such as silicon (Si); carbon thin films of diamond or the like; and conductive metal oxides, such as ITO (indium-tin oxide), indium oxide, and zinc oxide. Examples of methods for forming the electrode include combinations of a deposition process, such as an electron beam deposition process or a hot filament deposition process, a sputtering process, a CVD process, or an ion plating process and an etching process; a screen printing process; a plating process (such as an electroplating process or an electroless plating process); a lift-off process; a laser ablation process; and a sol-gel process. The screen printing process or plating process enables direct formation of the cathode electrode or gate electrode having, e.g., a strip form.

In the Spindt-type field emitter element, as examples of materials constituting the electron emitter, there can be mentioned at least one material selected from the group consisting of molybdenum, a molybdenum alloy, tungsten, a tungsten alloy, titanium, a titanium alloy, niobium, a niobium alloy, tantalum, a tantalum alloy, chromium, a chromium alloy, and silicon containing an impurity (polysilicon or amorphous silicon). The electron emitter in the Spindt-type field emitter element can be formed by a vacuum vapor deposition process or, e.g., a sputtering process or a CVD process.

In the flattened-type field emitter element, it is preferable that the material constituting the electron emitter has a work function $\Phi$ smaller than that of the material constituting the cathode electrode, and the material may be selected depending on the work function of the material constituting the cathode electrode, the potential difference between the gate electrode and the cathode electrode, the required emission current density, or the like. Alternatively, the material constituting the electron emitter may be appropriately selected from materials having a secondary electron gain $\delta$ larger than the secondary electron gain $\delta$ of the conductor constituting the cathode electrode. In the flattened-type field emitter element, especially preferred examples of the materials constituting the electron emitter include carbon, specifically, amorphous diamond, graphite, carbon nanotube structures (carbon nanotubes and/or graphite nanofibers), ZnO whisker, MgO whisker, $SnO_2$ whisker, MnO whisker, $Y_2O_3$ whisker, NiO whisker, ITO whisker, $In_2O_3$ whisker, and $Al_2O_3$ whisker. The material constituting the electron emitter may not have conductivity.

As a material constituting the insulating layer or interlayer dielectric layer, $SiO_2$ materials, such as $SiO_2$, BPSG, PSG, BSG, AsSG, PbSG, SiON, SOG (spin on glass), low melting-point glass, and a glass paste; SiN materials; and insulating resins, such as polyimide, can be used individually or in combination. In forming the insulating layer or interlayer dielectric layer, a known process, such as a CVD process, a coating process, a sputtering process, or a screen printing process, can be used.

The flat form, that is, the form obtained by cutting the opening along a virtual plane parallel to the support surface, of the first opening (opening formed in the gate electrode) or second opening (opening formed in the insulating layer) can be an arbitrary form, such as a circular form, an elliptical form, a rectangular form, a polygonal form, a rounded rectangular form, or a rounded polygonal form. The first opening can be formed by, for example, anisotropic etching, isotropic etching, or a combination of anisotropic etching and isotropic etching, and, depending on the method of forming the gate electrode, the first opening can be directly formed. The second opening can be formed by, for example, anisotropic etching, isotropic etching, or a combination of anisotropic etching and isotropic etching.

In the field emitter element, depending on the structure of the field emitter element, one electron emitter may be present in one opening, a plurality of electron emitters may be present in one opening, or one or a plurality of electron emitters may be present in one second opening, formed in the insulating layer, in communication with a plurality of first openings formed in the gate electrode.

In the field emitter element, a resistance thin film may be formed between the cathode electrode and the electron emitter. By virtue of the resistance thin film, the action of the field emitter element can be stabilized, and the electron emission properties can be uniform. Examples of materials constituting the resistance thin film include carbon resistance materials, such as silicon carbide (SiC) and SiCN; SiN; semiconductor resistance materials, such as amorphous silicon; and refractory metal oxides and refractory metal nitrides, such as ruthenium oxide ($RuO_2$), tantalum oxide, and tantalum nitride. Examples of methods for forming the resistance thin film include a sputtering process, a CVD process, and a screen printing process. The electric resistance per electron emitter may be generally $1\times10^6$ $\Omega$ to $1\times10^{11}$ $\Omega$, preferably several tens G$\Omega$.

Joining the cathode panel and the anode panel together at their edges may be conducted either using a joint member which comprises a bonding layer or using a joint member which comprises a frame composed of an insulating rigid material, such as glass or ceramic, having a rod shape or a frame shape, and a bonding layer. When using a joint member which comprises a frame and a bonding layer, the distance between the cathode panel and the anode panel can be long due to appropriate selection of the height of the frame, as compared to that obtained when using a joint member which comprises only a bonding layer. As a material constituting the bonding layer, frit glass, such as $B_2O_3$—PbO frit glass or $SiO_2$—$B_2O_3$—PbO frit glass, is generally used, but a so-called low melting-point metal material having a melting point of about 120° C. to 400° C. may be used. Examples of the low melting-point metal materials include In (indium; melting point: 157° C.); indium-gold low melting-point alloys; tin (Sn) high-temperature solder, such as $Sn_{80}Ag_{20}$ (melting point: 220° C. to 370° C.) and $Sn_{95}Cu_5$ (melting point: 227° C. to 370° C.); lead (Pb)

high-temperature solder, such as $Pb_{97.5}Ag_{2.5}$ (melting point: 304° C.), $Pb_{94.5}Ag_{5.5}$ (melting point: 304° C. to 365° C.), and $Pb_{97.5}Ag_{1.5}Sn_{1.0}$ (melting point: 309° C.); zinc (Zn) high-temperature solder, such as $Zn_{95}Al_5$ (melting point: 380° C.); tin-lead standard solder, such as $Sn_5Pb_{95}$ (melting point: 300° C. to 314° C.) and $Sn_2Pb_{98}$ (melting point: 316° C. to 322° C.); and brazing materials, such as $Au_{88}Ga_{12}$ (melting point: 381° C.)(wherein each subscript indicates atomic %).

The three members, i.e., the cathode panel, the anode panel, and the joint member may be joined together either in a way such that the three members are joined together at the same time or in a way such that the cathode panel or anode panel and the joint member are first joined together on a first stage and then the remaining cathode panel or anode panel and the joint member are joined on a second stage. If joining the three members together at the same time or the joining on the second stage is conducted in a high-vacuum atmosphere, a space between the cathode panel, the anode panel, and the joint member becomes a vacuum simultaneously with joining them. Alternatively, after joining the three members together, a space between the cathode panel, the anode panel, and the joint member can be evacuated to create a vacuum. In a case of evacuating the space after the joining, the pressure in the atmosphere for the joining may be either the atmospheric pressure or a reduced pressure, and gas constituting the atmosphere is preferably inert gas composed of nitrogen gas or gas of element belonging to Group 0 of the Periodic Table (e.g., Ar gas). Alternatively, a low oxygen-gas concentration atmosphere (oxygen gas concentration: e.g., 100 ppm or less) can be used.

Evacuating the space can be performed through an exhaust pipe, called also a tip pipe, preliminarily connected to the cathode panel and/or anode panel. The exhaust pipe is typically composed of a glass tube, or a hollow tube made of a metal or an alloy having a low coefficient of thermal expansion. Such an alloy includes, for example, an iron (Fe) alloy containing 42% by weight of nickel (Ni), or an iron (Fe) alloy containing 42% by weight of nickel (Ni) and 6% by weight of chromium (Cr). The exhaust pipe is joined to the periphery of a through-hole formed in the cathode panel and/or anode panel in an ineffective region using the above-mentioned frit glass or low melting-point metal material. Herein, the ineffective region is an area in the form of a frame surrounding the effective region as a display area at the center having a practical function of the flat-type display device. The exhaust pipe is cut and sealed by heat-fusion or contact bonding after the space has reached a predetermined degree of vacuum. When the whole of the flat-type display device is heated and then cooled before sealing the exhaust pipe, the space can release residual gas, so that the residual gas can be advantageously removed from the space by evacuation.

A space between the cathode panel and the anode panel is maintained at a high vacuum. Therefore, a spacer composed of a high resistance material, such as a ceramic material or glass, must be placed between the cathode panel and the anode panel for preventing the flat-type display device from suffering a damage due to the atmospheric pressure.

The spacer can be composed of, for example, ceramic or glass. Examples of ceramics constituting the spacer include mullite, alumina, barium titanate, lead titanate zirconate, zirconia, cordierite, barium borosilicate, iron silicate, glass ceramic materials, and the above materials containing titanium oxide, chromium oxide, iron oxide, vanadium oxide, or nickel oxide. In this case, the spacer can be produced by molding a so-called green sheet and calcining the sheet, and cutting the green sheet calcined article. Examples of glass constituting the spacer include soda-lime glass. The spacer may be fixed by, for example, disposing it between a barrier and another barrier, or fixed by a spacer holder formed in the anode panel and/or the cathode panel.

On the surface of the spacer may be formed an antistatic film. It is preferable that the antistatic film is composed of a material having a coefficient of secondary electron emission close to 1, and, as a material constituting the antistatic film, a semi-metal, such as graphite, an oxide, a boride, a carbide, a sulfide, or a nitride can be used. Examples of the materials include semi-metals, such as graphite, and compounds containing a semi-metal element, such as $MoSe_2$; oxides, such as $CrO_x$, $CrAl_xO_y$, $Nd_2O_3$, $La_xBa_{2-x}CuO_4$, $La_xBa_{2-x}CuO_4$, and $La_xY_{1-x}CrO_3$; borides, such as $AlB_2$ and $TiB_2$; carbides, such as SiC; sulfides, such as $MoS_2$ and $WS_2$; and nitrides, such as BN, TiN, and AlN, and further, for example, materials described in Japanese Translation of PCT Application Publication No. 2004-500688 and others can be used. The antistatic film may be composed of either a single material or a plurality of materials, and may be of either a single-layer structure or a multilayer structure. The antistatic film can be formed by a known method, such as a sputtering process, a vacuum vapor deposition process, or a CVD process.

DETAILED DESCRIPTION

Embodiments are described in detail with reference to the following Examples and the accompanying drawings.

EXAMPLE 1

Figure 1:
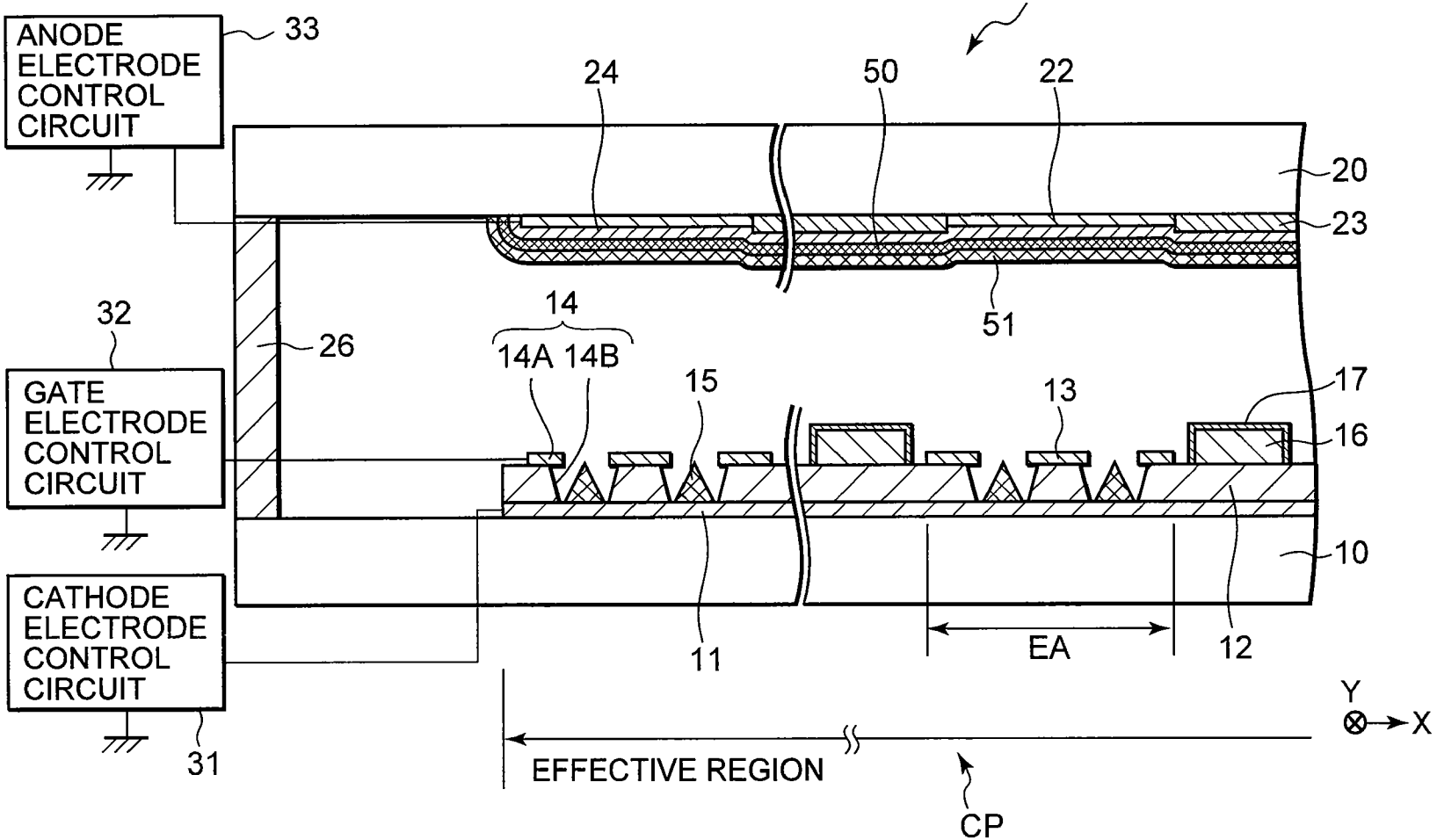
FIG. 1 is a diagrammatic fragmentary end view of the flat-type display device having a Spindt-type cold cathode field emitter element in Example 1.

Example 1 is directed to a flat-type display device. Specifically, the flat-type display device in Example 1 or below-mentioned Example 2 or 3 is a cold cathode field emission display device (hereinafter, referred to simply as "display device"). A diagrammatic fragmentary end view of the display device in Example 1 is shown in FIG. 1.

Figure 12:
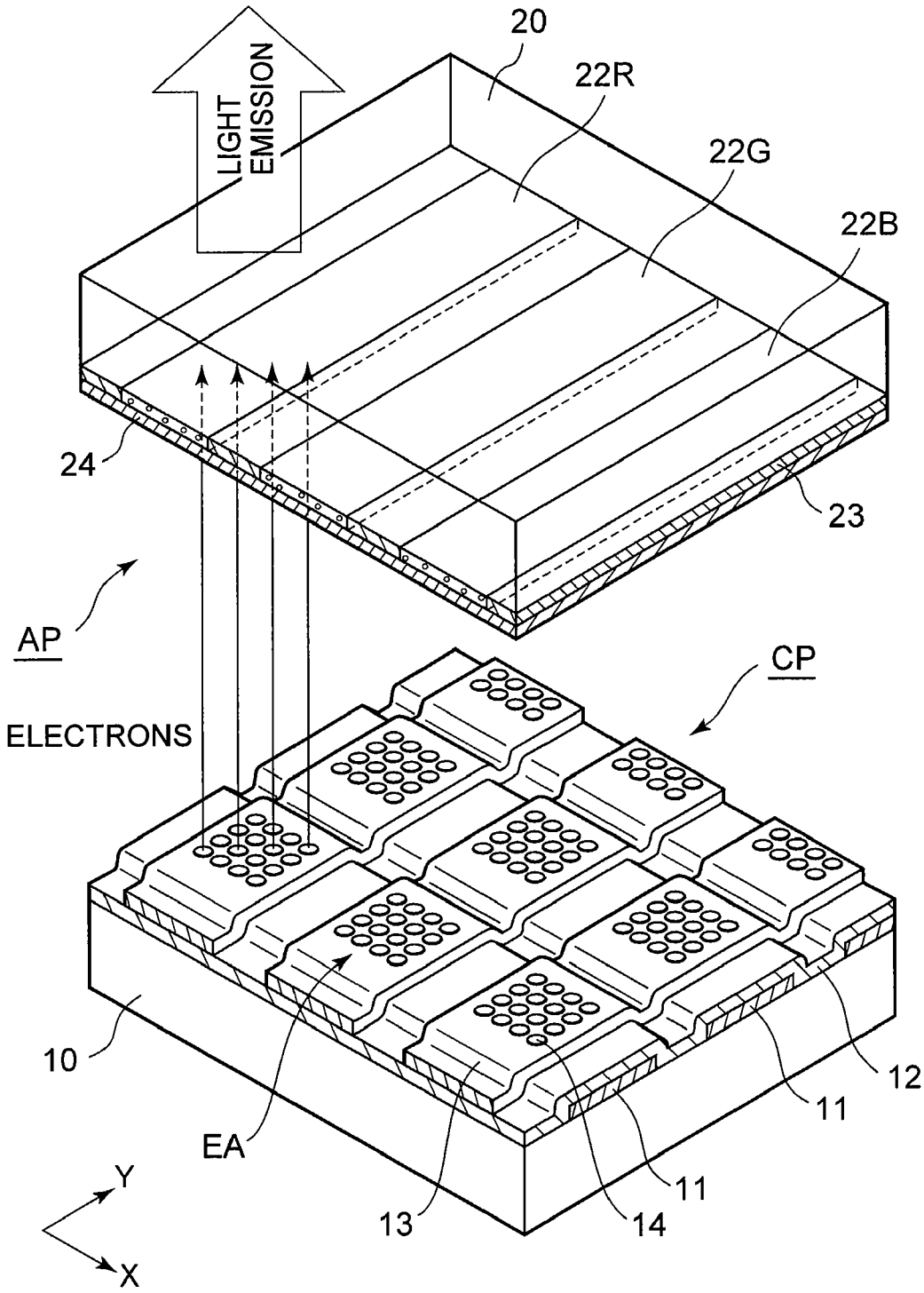
FIG. 12 is a partial, diagrammatic exploded perspective view of a cathode panel and an anode panel in a cold cathode field emission display device.

The display device in Example 1 or below-mentioned Example 2 or 3 is a display device which includes a cathode panel CP having a plurality of electron emitter areas EA formed on a support 10, and an anode panel AP having formed on a substrate 20 a plurality of fluorescent regions 22 and an anode electrode 24 covering at least the fluorescent regions 22. In the display device, the cathode panel CP and the anode panel AP are joined together at their edges with a joint member 26 in between. The electron emitter areas EA are arrayed in a two-dimensional matrix form on a portion of the support 10 constituting an effective region, and the fluorescent regions 22 are arrayed in a two-dimensional matrix form on a portion of the substrate 20 constituting the effective region so that each fluorescent region 22 faces the electron emitter areas EA. Herein, the effective region means a display area at substantially the center having a practical function of the flat-type display device, i.e., image display function, and the effective region is surrounded by an ineffective region in the form of a frame. A space between the cathode panel CP and the anode panel AP is a vacuum (pressure: e.g., $10^{-3}$ Pa or less). A partial, diagrammatic exploded perspective view of the cathode panel CP and the anode panel AP separated from each other is basically similar to that shown in FIG. 12.

Figure 2:
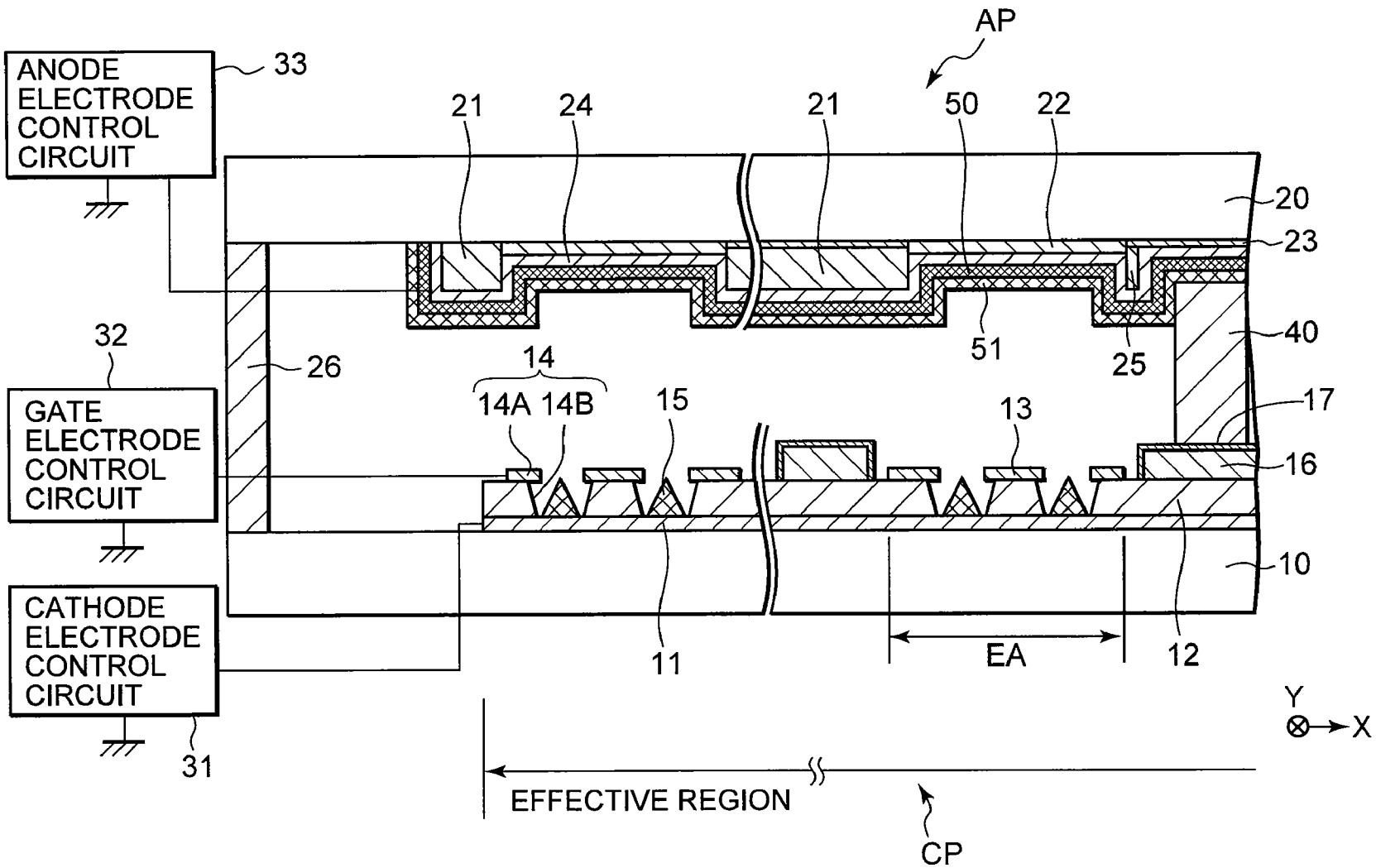
FIG. 2 is a diagrammatic fragmentary end view of the flat-type display device having a Spindt-type cold cathode field emitter element in Example 2.
Figure 3:
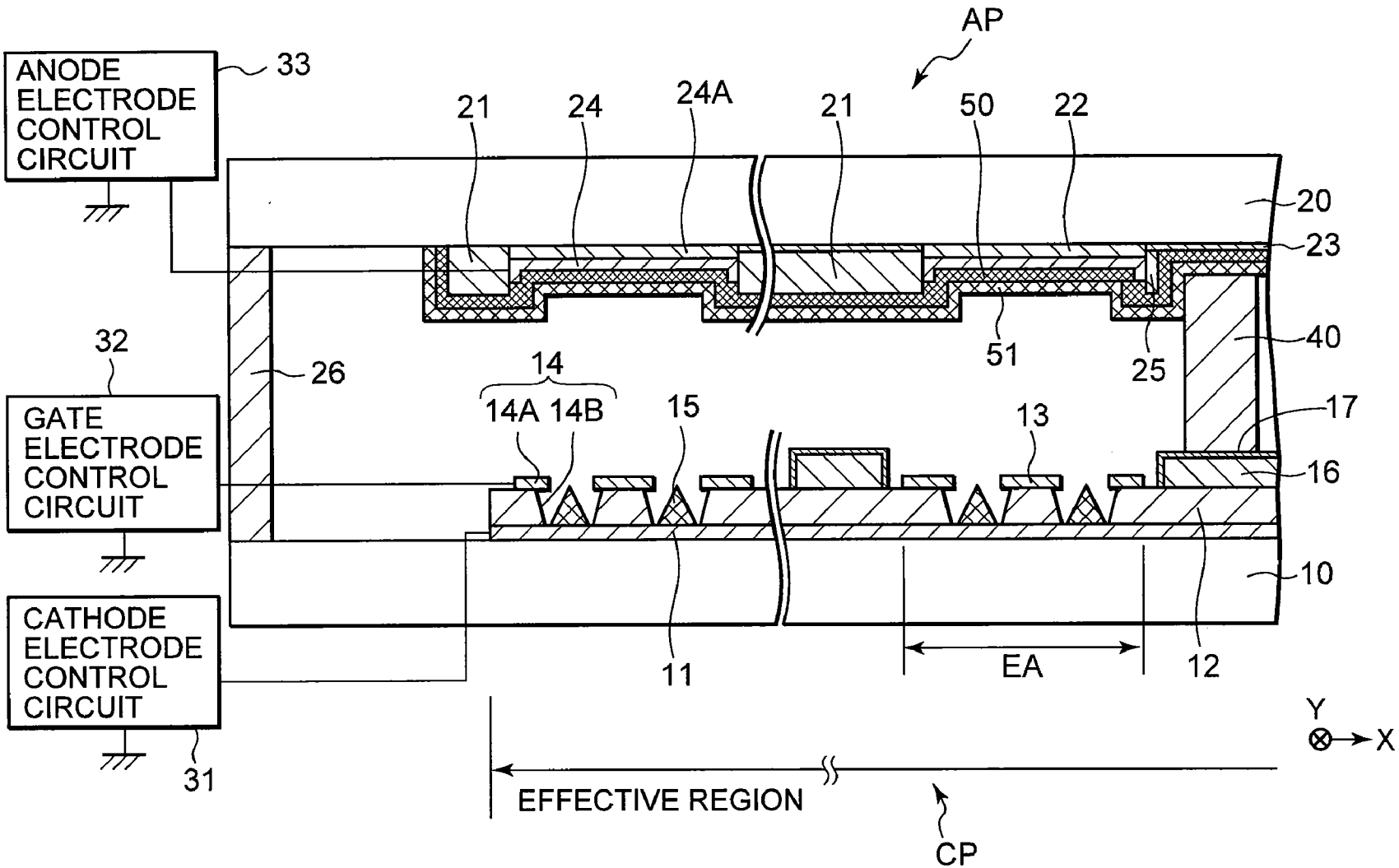
FIG. 3 is a diagrammatic fragmentary end view of the flat-type display device having a Spindt-type cold cathode field emitter element in Example 3.
Figure 4:
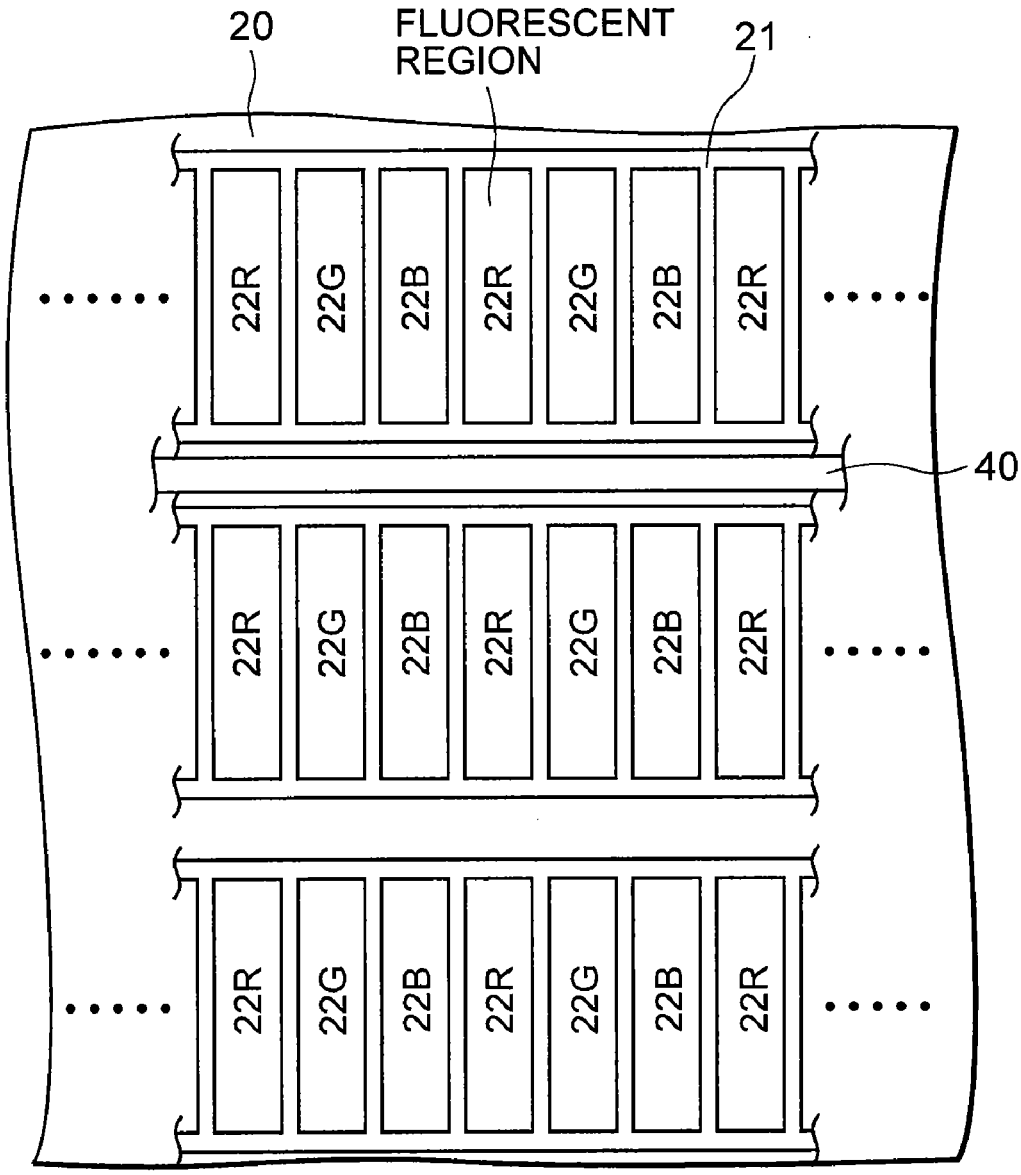
FIG. 4 is a view diagrammatically showing the arrangement of a barrier, a spacer, and fluorescent regions in the anode panel constituting the flat-type display device.

In Example 1 or below-mentioned Example 2 or 3, an electron emitter element constituting the electron emitter areas EA is configured with, for example, a Spindt-type cold cathode field emitter element (hereinafter, referred to as "field emitter element"). Specifically, the Spindt-type field emitter element, as shown in FIGS. 1 to 3, includes:

(a) a cathode electrode 11 formed on a support 10;

(b) an insulating layer 12 formed on the support 10 and the cathode electrode 11;

(c) a gate electrode 13 formed on the insulating layer 12;

(d) openings 14 formed in the gate electrode 13 and the insulating layer 12 (a first opening 14A formed in the gate electrode 13 and a second opening 14B formed in the insulating layer 12); and (e) a conical electron emitter 15 formed on the cathode electrode 11 at the bottom of each opening 14.

Figure 11:
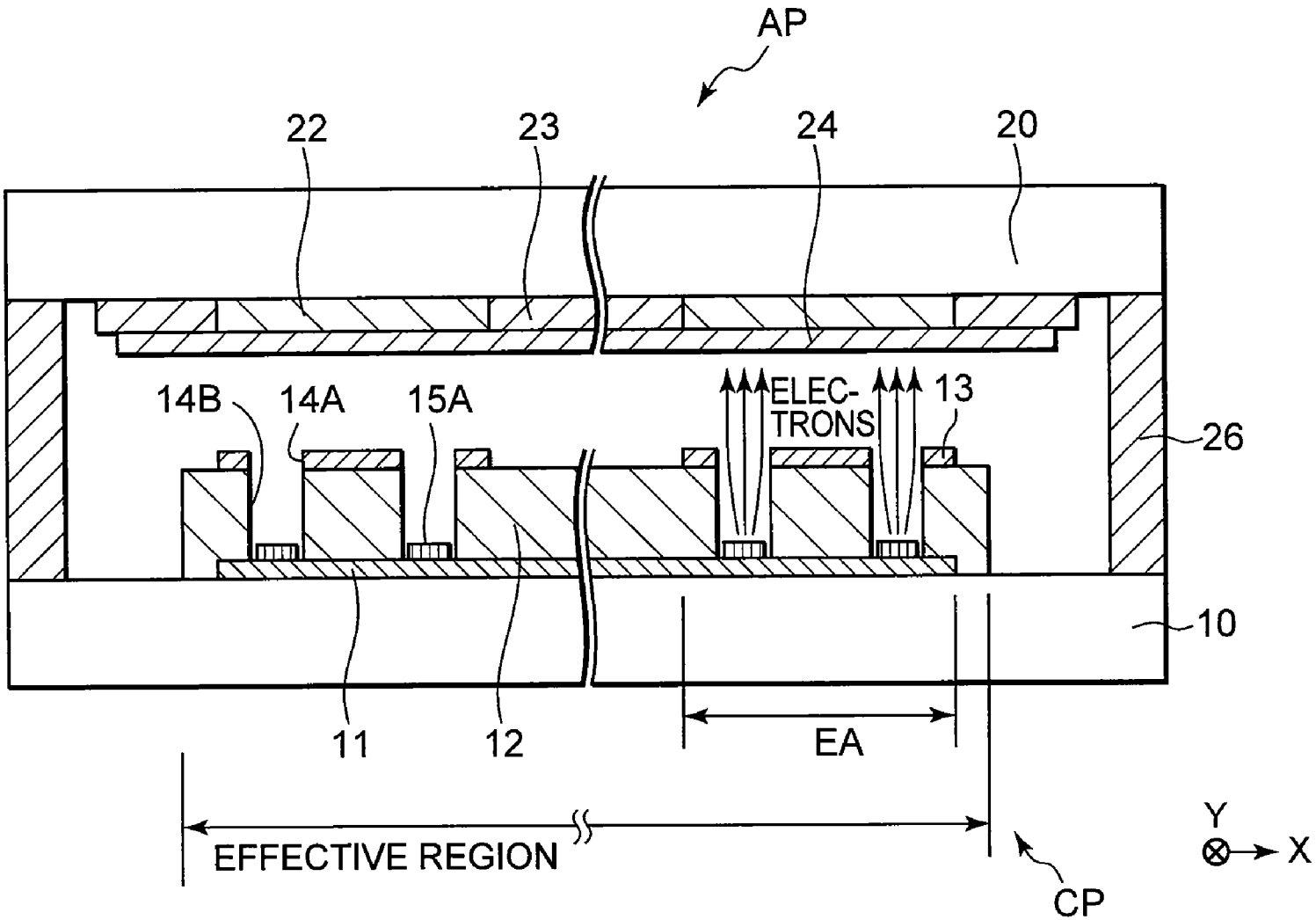
FIG. 11 is a diagrammatic fragmentary end view of a related art flat-type display device having a flattened-type cold cathode field emitter element.

Alternatively, in Example 1 or below-mentioned Example 2 or 3, the electron emitter element is configured with, for example, a flattened-type field emitter element. Specifically, the flattened-type field emitter element, as shown in FIG. 11, includes:

(a) a cathode electrode 11 formed on a support 10;

(b) an insulating layer 12 formed on the support 10 and the cathode electrode 11;

(c) a gate electrode 13 formed on the insulating layer 12;

(d) openings 14 formed in the gate electrode 13 and insulating layer 12 (a first opening 14A formed in the gate electrode 13 and a second opening 14B formed in the insulating layer 12); and (e) an electron emitter 15A formed on the cathode electrode 11 at the bottom of each opening 14.

The electron emitter 15A is configured with, for example, a number of carbon nanotubes, part of which are buried in the matrix.

In the cathode panel CP, the cathode electrode 11 is in the form of a strip extending in a first direction (see the X direction shown in the figures), and the gate electrode 13 is in the form of a strip extending in a second direction (see the Y direction shown in the figures) different from the first direction. The cathode electrode 11 and the gate electrode 13 are formed in strips in respective directions such that images from the electrodes 11, 13 cross at a right angle. The electron emitter area EA corresponding to one subpixel has a plurality of field emitter elements. An interlayer dielectric layer 16 is formed on the insulating layer 12 and the gate electrode 13, and a focusing electrode 17 is formed on the interlayer dielectric layer 16 along a predetermined array direction of the field emitter elements, thus offering a focusing effect common to a plurality of field emitter elements.

In Example 1, the anode panel AP is essentially composed of a plurality of fluorescent regions 22 formed on a substrate 20, and an anode electrode 24 covering each fluorescent region 22. The fluorescent regions 22 include a red light-emitting fluorescent region 22R, a green light-emitting fluorescent region 22G, and a blue light-emitting fluorescent region 22B. The anode electrode is formed by a vacuum vapor deposition process and composed of aluminum (Al) having a thickness of 100 nm.

On the substrate 20 between a fluorescent region 22 and another fluorescent region 22 is formed a light absorbing layer (black matrix) 23 for preventing the occurrence of color mixing in the display image, i.e., optical cross talk. Further, between the cathode panel CP and the anode panel AP is disposed a spacer 40 (not shown in FIG. 1) composed of alumina ($Al_2O_3$; purity: 99.8% by weight).

Some electrons collide with the anode electrode 24 or fluorescent regions 22 and bounce in the direction from the anode panel AP to the cathode panel, or some secondary electrons are emitted in the direction from the fluorescent regions to the cathode panel due to the collision of electrons with the fluorescent regions. Such bouncing electrons and secondary electrons are collectively referred to as "backscattering electrons". On the anode electrode 24 is formed an electron absorbing layer 51 for absorbing the backscattering electrons from any one of the fluorescent regions 22 and the anode electrode 24 or both. The electron absorbing layer 51 is composed of carbon and has an average thickness of 100 nm to 300 nm, and is formed by a sputtering process.

An adhesion improving layer 50 is formed between the anode electrode 24 and the electron absorbing layer 51. The adhesion improving layer 50 is composed of a silicon carbide layer (specifically, SiC containing carbon of 30 mol % or more and 90 mol % or less) having an average thickness of 20 nm, a layer composed of silicon carbide and boron carbide ($B_4C$) and having an average thickness of 20 nm, or a tungsten carbide layer having an average thickness of 20 nm, and is formed by a sputtering process.

In the anode panel AP in Example 1, more specifically, the anode electrode 24 is formed both on the light absorbing layer (black matrix) 23 formed on the substrate 20 and on the fluorescent regions 22 formed on the substrate 20, and the adhesion improving layer 50 is formed on the entire surface of the anode electrode 24, and the electron absorbing layer 51 is formed on the adhesion improving layer 50.

In the display device in Example 1 or below-mentioned Example 2 or 3, the cathode electrode 11 is connected to a cathode electrode control circuit 31, the gate electrode 13 is connected to a gate electrode control circuit 32, the focusing electrode is connected to a focusing electrode control circuit (not shown), and the anode electrode 24 is connected to an anode electrode control circuit 33. These control circuits can be configured with a known circuit. In an actual operation of the display device, an anode voltage $V_A$ applied to the anode electrode 24 from the anode electrode control circuit 33 is generally constant, and can be, for example, 5 kV to 15 kV. On the other hand, with respect to a voltage $V_C$ applied to the cathode electrode 11 and a voltage $V_G$ applied to the gate electrode 13 in an actual operation of the display device, any one of the following systems can be employed:

(1) a system in which the voltage $V_C$ applied to the cathode electrode 11 is constant, and the voltage $V_G$ applied to the gate electrode 13 is changed;

(2) a system in which the voltage $V_C$ applied to the cathode electrode 11 is changed, and the voltage $V_G$ applied to the gate electrode 13 is constant; and (3) a system in which the voltage $V_C$ applied to the cathode electrode 11 is changed, and the voltage $V_G$ applied to the gate electrode 13 is also changed.

In an actual operation of the display device, a relatively negative voltage ($V_C$) is applied to the cathode electrode 11 from the cathode electrode control circuit 31, a relatively positive voltage ($V_G$) is applied to the gate electrode 13 from the gate electrode control circuit 32, and, for example, 0 V is applied to the focusing electrode 17 from the focusing electrode control circuit (not shown), and a positive voltage (anode voltage $V_A$) higher than the voltage applied to the gate electrode 13 is applied to the anode electrode 24 from the anode electrode control circuit 33. In a case where display is made by the display device, for example, a scanning signal is input into the cathode electrode 11 from the cathode electrode control circuit 31, and a video signal is input into the gate electrode 13 from the gate electrode control circuit 32. Note that a video signal may be input into the cathode electrode 11 from the cathode electrode control circuit 31, and a scanning signal may be input into the gate electrode 13 from the gate electrode control circuit 32. An electric field resulting from applying a voltage across the cathode electrode 11 and the gate electrode 13 causes the electron emitter 15 or 15A to emit electrons due to a quantum tunnel effect, and the electrons are attracted by the anode electrode 24 and pass through the anode electrode 24 and collide with the fluorescent regions 22, so that the fluorescent regions 22 are excited to emit light, thus obtaining a desired image. Accordingly, the operation of the display device is basically controlled by changing the voltage $V_G$ applied to the gate electrode 13 and the voltage $V_C$ applied to the cathode electrode 11.

Herein below, a method for producing the flat-type display device in Example 1 is described.

[Step-100]

A lattice-like light absorbing layer (black matrix) 23 composed of chromium oxide is first formed on a substrate 20.

[Step-110]

Then, fluorescent regions 22 are formed on exposed surface portions of the substrate 20 surrounded by the light absorbing layer 23. Specifically, for forming a red light-emitting fluorescent region 22R, a red light-emitting fluorescent slurry, which is prepared by dispersing red light-emitting fluorescent particles in, e.g., a polyvinyl alcohol (PVA) resin and water and adding ammonium bichromate to the resultant dispersion, is applied to the entire surface, and then the red light-emitting fluorescent slurry is dried. Then, the red light-emitting fluorescent slurry is exposed by irradiation of a portion of the red light-emitting fluorescent slurry where the red light-emitting fluorescent region 22R will be formed with ultraviolet light from the substrate 20 side. The red light-emitting fluorescent slurry is gradually cured from the substrate 20 side. The thickness of the red light-emitting fluorescent region 22R to be formed is determined depending on the irradiation dose of ultraviolet light to the red light-emitting fluorescent slurry. In this Example, the irradiation time of ultraviolet light to the red light-emitting fluorescent slurry is controlled so that the red light-emitting fluorescent region 22R has a thickness of about 8 μm. Then, the red light-emitting fluorescent slurry is developed, thereby forming the red light-emitting fluorescent region 22R in a predetermined region. Subsequently, a green light-emitting fluorescent slurry is subjected to similar process to form a green light-emitting fluorescent region 22G, and further a blue light-emitting fluorescent slurry is subjected to similar process to form a blue light-emitting fluorescent region 22B. The method for forming the fluorescent regions is not limited to the above-described method, and there may be employed a method in which a red light-emitting fluorescent paste, a green light-emitting fluorescent paste, and a blue light-emitting fluorescent paste are successively applied in an arbitrary pattern and then the individual fluorescent paste applied regions are successively exposed and developed to form fluorescent regions, or a method in which fluorescent regions are individually formed by, e.g., a screen printing process.

[Step-120]

Then, a resin layer is formed on the entire surface. Specifically, a resin layer can be formed in accordance with a metal mask printing process or a screen printing process. Next, the resin layer is dried. Specifically, the substrate 20 is placed in a drying furnace and dried at a predetermined temperature. The drying temperature for the resin layer is preferably in the range of from 50° C. to 90° C., and the drying time for the resin layer is preferably, in the range of from several to several tens minutes. The drying time is appropriately shortened or lengthened depending on the drying temperature. Alternatively, the resin layer can be formed by the following method. The substrate 20 having the fluorescent regions 22 formed thereon is immersed in liquid (specifically, water) contained in a treatment bath so that the fluorescent regions 22 face the liquid surface. A drainage portion of the treatment bath is closed. Then, a resin layer having a substantially flat surface is formed on the liquid surface. Specifically, an organic solvent having dissolved a resin (lacquer) forming the resin layer is applied dropwise to the liquid surface. That is, a material forming the resin layer is developed onto the liquid surface. The resin (lacquer) constituting the resin layer is composed of a kind of varnish in a broad sense, which is obtained by dissolving a composition composed mainly of a cellulose derivative, generally nitrocellulose in a volatile solvent, such as a lower fatty acid ester, or an urethane lacquer or acrylic lacquer using another synthetic polymer. Subsequently, the floating resin layer material on the liquid surface is dried for, e.g., about two minutes to form a film of the resin layer material, thus obtaining a flat resin layer on the liquid surface. In forming the resin layer, the amount of the resin layer material developed is controlled so that the resultant resin layer has, for example, a thickness of about 30 nm. Then, the drainage portion of the treatment bath is opened and the liquid is drained from the treatment bath to allow the liquid surface to go down, so that the resin layer formed on the liquid surface moves in the direction to the substrate 20, and the resin layer is in contact with the fluorescent regions 22 and the light absorbing layer 23 and finally remains on the fluorescent regions 22 and the light absorbing layer 23.

[Step-130]

Then, a conductor layer is formed on the entire surface (specifically, on the resin layer). Specifically, a conductor layer composed of, e.g., aluminum (Al) is formed by a vacuum vapor deposition process or a sputtering process so that the conductor layer covers the resin layer.

[Step-140]

Next, the resin layer is removed by a heat treatment. Specifically, the resin layer is calcined at about 400° C. This calcination treatment causes the resin layer to burn, so that the conductor layer (anode electrode 24) composed of aluminum remains both on the fluorescent regions 22 and on the light absorbing layer 23. Gas generated in burning of the resin layer is discharged through, for example, fine pores formed in the conductor layer. The pores in the conductor layer are very fine and hence do not adversely affect the structural strength of the anode electrode 24 or the image display properties.

[Step-150]

Then, an adhesion improving layer 50 is formed on the entire surface by a sputtering process, and an electron absorbing layer 51 is formed on the adhesion improving layer 50 by a sputtering process. Examples of conditions for forming the adhesion improving layer 50 composed of a silicon carbide layer in accordance with a sputtering process are shown in Table 1 below. Examples of conditions for forming the electron absorbing layer 51 comprised of carbon in accordance with a sputtering process are shown in Table 2 below.

TABLE 1

CONDITIONS FOR FORMING ADHESION IMPROVING LAYER COMPOSED OF SILICON CARBIDE LAYER

| | |
|---|---|
| Atmosphere: | Ar gas atmosphere |
| Pressure: | 0.65 Pa |
| Target power: | 6.5 W/cm$^2$ |

TABLE 2

CONDITIONS FOR FORMING ELECTRON ABSORBING LAYER COMPRISED OF CARBON

| | |
|---|---|
| Atmosphere: | Ar gas atmosphere |
| Pressure: | 0.6 Pa |
| Target power: | 7.5 W/cm$^2$ |

The steps described above are conducted, thus completing an anode panel AP.

[Step-160]

A cathode panel CP having a field emitter element formed thereon is prepared. Then, a display device is assembled. Specifically, for example, a spacer 40 is fitted to a spacer holder 25 formed in the effective region of the anode panel AP, and the anode panel AP and the cathode panel CP are arranged so that the fluorescent regions 22 face the electron emitter areas EA, and the anode panel AP and the cathode panel CP, more specifically, the substrate 20 and the support 10, are joined together at their edges with a joint member 26 in between including a frame composed of ceramic or glass having a height of about 2 mm and a bonding layer composed of frit glass. In joining them, the bonding layer may be calcined in, for example, a nitrogen gas atmosphere at about 400° C. for 10 to 30 minutes. Then, the space between the anode panel AP, the cathode panel CP, and the joint member 26 is evacuated through a through-hole (not shown) and an exhaust pipe (not shown), and the exhaust pipe is cut and sealed by heat-fusion after the pressure in the space has reached about $10^{-4}$ Pa. Thus, a vacuum can be created in the space between the anode panel AP, the cathode panel CP, and the joint member 26. Alternatively, for example, the joint member 26, the anode panel AP, and the cathode panel CP may be joined together in a high-vacuum atmosphere. Further alternatively, depending on the structure of the display device, the anode panel AP and the cathode panel CP may be joined together with a joint member composed only of a bonding layer without using a frame. Subsequently, connection to a required external circuit through a wiring is made, thus completing the display device.

In Example 1, on the anode electrode 24 is formed the adhesion improving layer 50 composed of a silicon carbide layer having an average thickness of 20 nm, the adhesion improving layer 50 composed of a layer made of silicon carbide and boron carbide and having an average thickness of 20 nm, or the adhesion improving layer 50 composed of a tungsten carbide layer having an average thickness of 20 nm. Therefore, in the calcination of the bonding layer in a nitrogen gas atmosphere at about 400° C. for 10 to 30 minutes in the [step-160], a problem exists in that the electron absorbing layer 51 was peeled off the adhesion improving layer 50 or a crack was caused in the electron absorbing layer 51 did not occur.

For comparison, the adhesion improving layer 50 was not formed and the electron absorbing layer 51 was directly formed on the anode electrode 24 by a sputtering process in a step similar to the [step-150] to prepare an anode panel, and then a display device was assembled in a step similar to the [step-160]. In the calcination of the bonding layer in a nitrogen gas atmosphere at about 400° C. for 10 to 30 minutes, the electron absorbing layer 51 was disadvantageously peeled off the anode electrode 24.

Between the [step-140] and the [step-150], the surface of the anode electrode 24 may be subjected to a cleaning treatment to remove oxide films formed on the surface of the anode electrode 24 or organic substances and the like deposited on the surface of the anode electrode 24, thus making it possible to further improve the adhesion of the adhesion improving layer 50 to the anode electrode 24. Specifically, a cleaning treatment of, e.g., plasma etching under conditions at an energy density of 5.7 W/cm$^2$ may be performed. This also applies to the Examples described below.

In the [step-150], before forming the electron absorbing layer 51 composed of carbon on the entire surface by a sputtering process, the atmosphere of a sputtering machine in which the anode panel AP is placed is satisfactorily cleaned. Such atmosphere can be obtained by, for example, lowering the vacuum background in the sputtering machine to $3.5\times10^{-4}$ Pa or less using a cryopump having an excellent ability to remove moisture, and keeping this state for 30 minutes or longer. Thereafter, the electron absorbing layer 51 is formed by a sputtering process. In this case, in the calcination of the bonding layer in a nitrogen gas atmosphere at about 400° C. for 10 to 30 minutes in the subsequent step, the sheet resistance of the electron absorbing layer 51 composed of carbon can be stably reduced to about 1/50, as compared to that achieved when the electron absorbing layer 51 is formed by a sputtering process without the above-mentioned treatment.

EXAMPLE 2

Example 2 is a variation of Example 1. In the anode panel AP in Example 2, a barrier 21 in a lattice-like pattern surrounding each fluorescent region 22 is formed on a substrate 20.

In Example 2, one pixel is composed of the red light-emitting fluorescent region 22R, green light-emitting fluorescent region 22G, and blue light-emitting fluorescent region 22B, and one subpixel is composed of the fluorescent region 22. As shown in a diagrammatic fragmentary end view of the display device of FIG. 2, differing from Example 1, in Example 2, each fluorescent region is surrounded by the barrier 21. The flat form of a portion of the lattice-like barrier 21 surrounding each fluorescent region, which corresponds to the inner contour of the image from the sidewall of the barrier, and is a kind of opening region, is a rectangular form or oblong. The flat forms (flat forms of the opening regions) are arrayed in a two-dimensional matrix form, more specifically, form of parallel crosses, to form the barrier 21 in a lattice-like pattern. Reference numeral 40 designates a spacer, and reference numeral 25 designates a spacer holder composed of the barrier 21.

Figure 5:
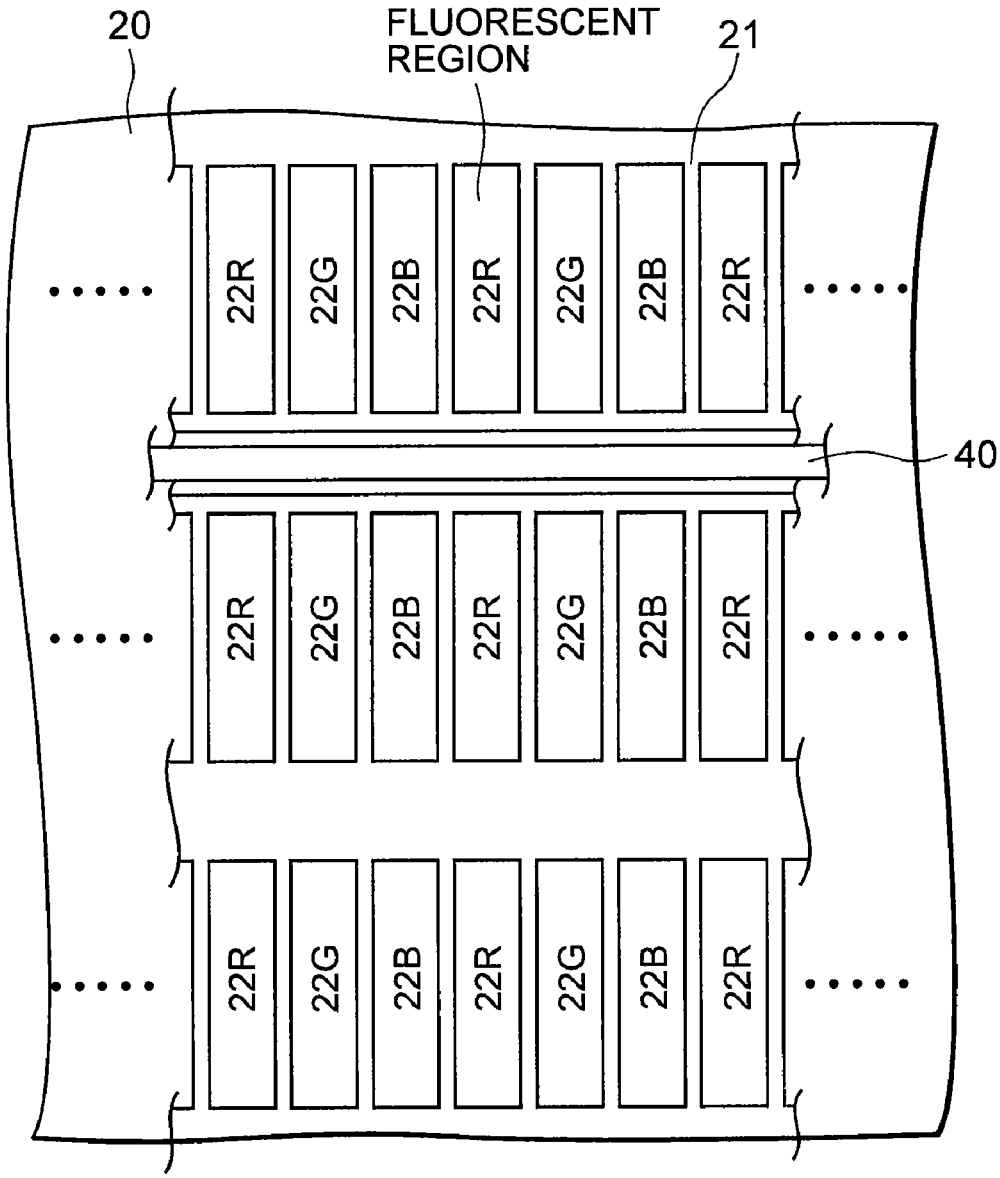
FIG. 5 is a view diagrammatically showing the arrangement of the barrier, spacer, and fluorescent regions in the anode panel constituting the flat-type display device.
Figure 6:
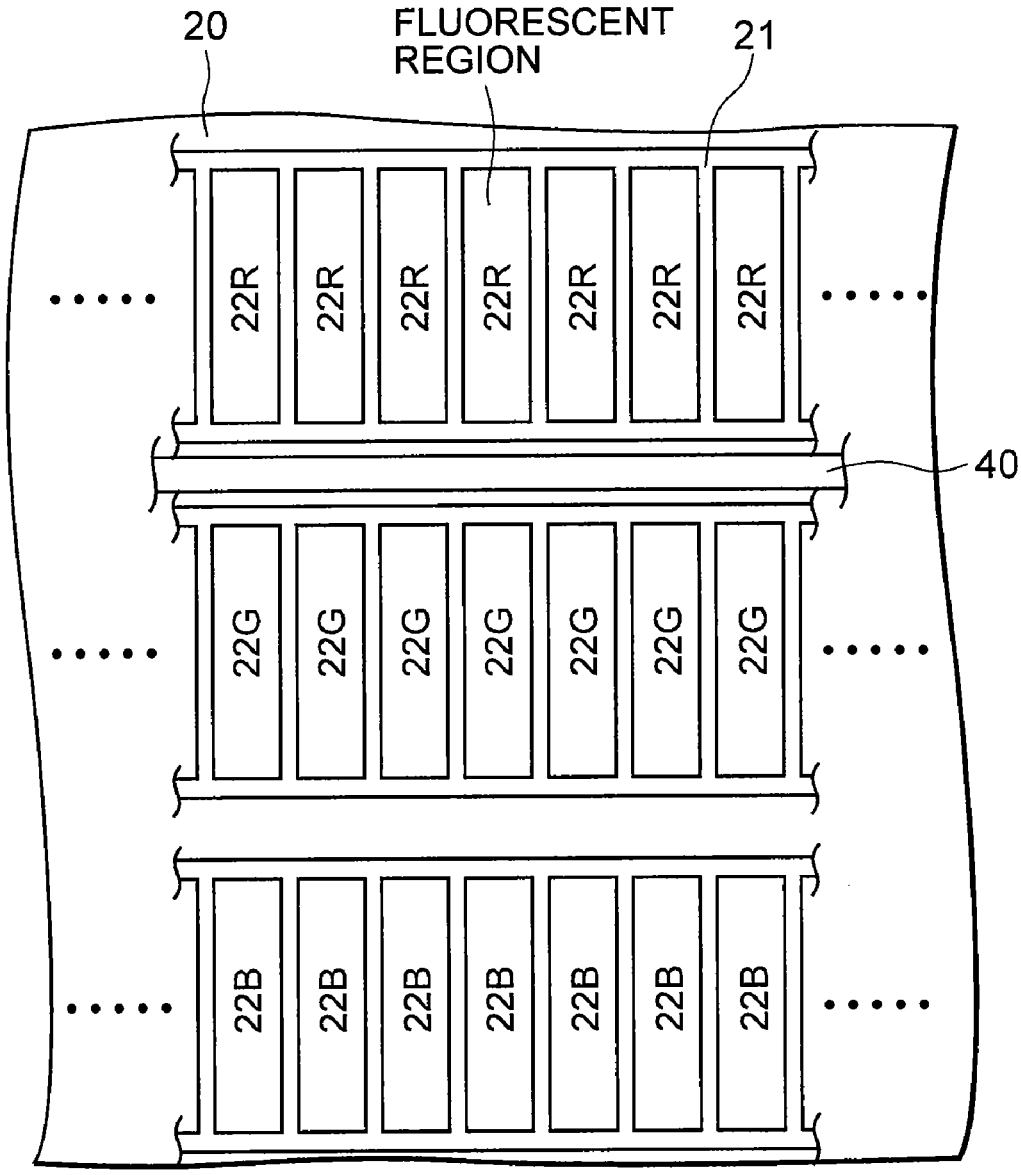
FIG. 6 is a view diagrammatically showing the arrangement of the barrier, spacer, and fluorescent regions in the anode panel constituting the flat-type display device.
Figure 7:
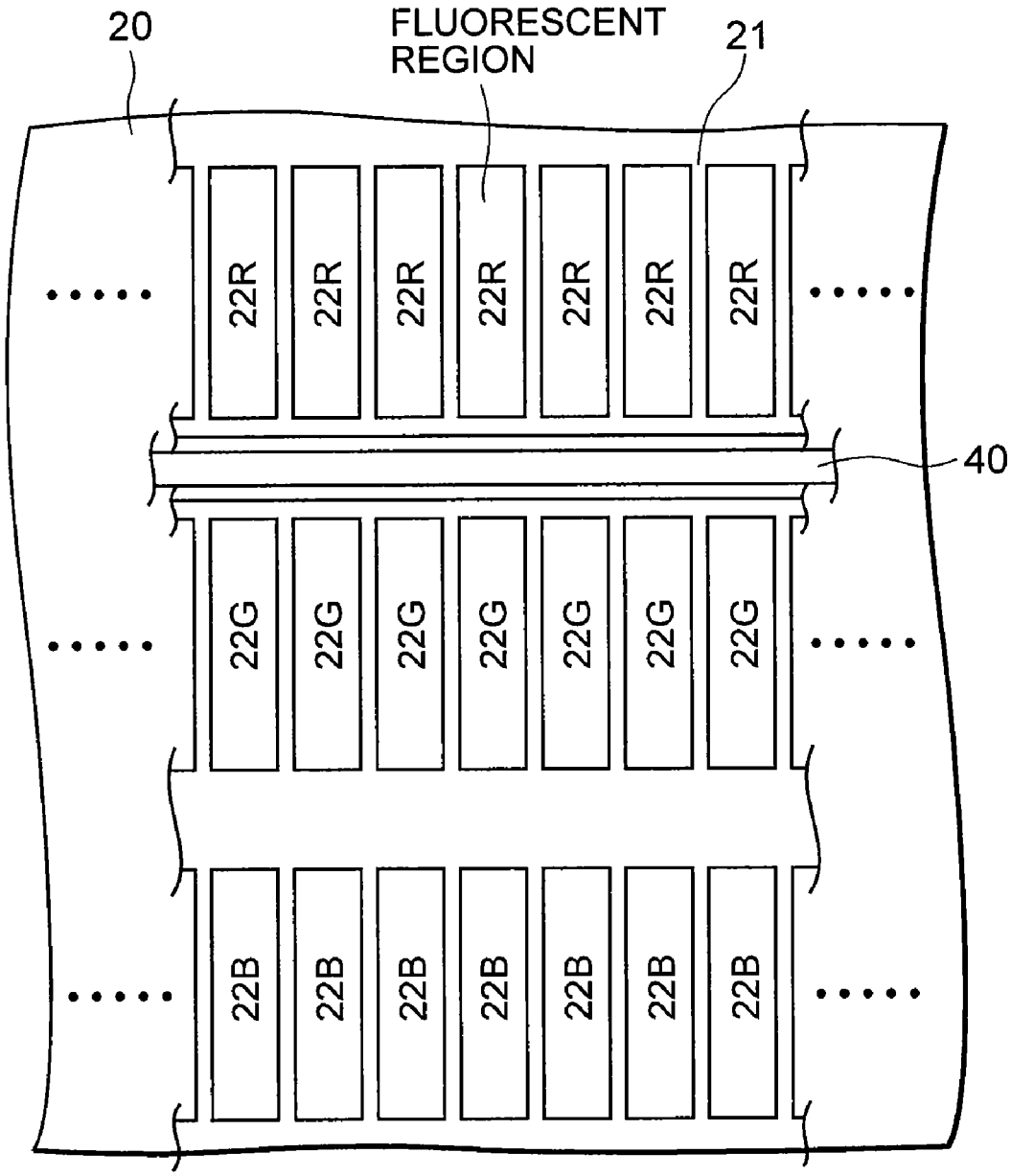
FIG. 7 is a view diagrammatically showing the arrangement of the barrier, spacer, and fluorescent regions in the anode panel constituting the flat-type display device.
Figure 8:
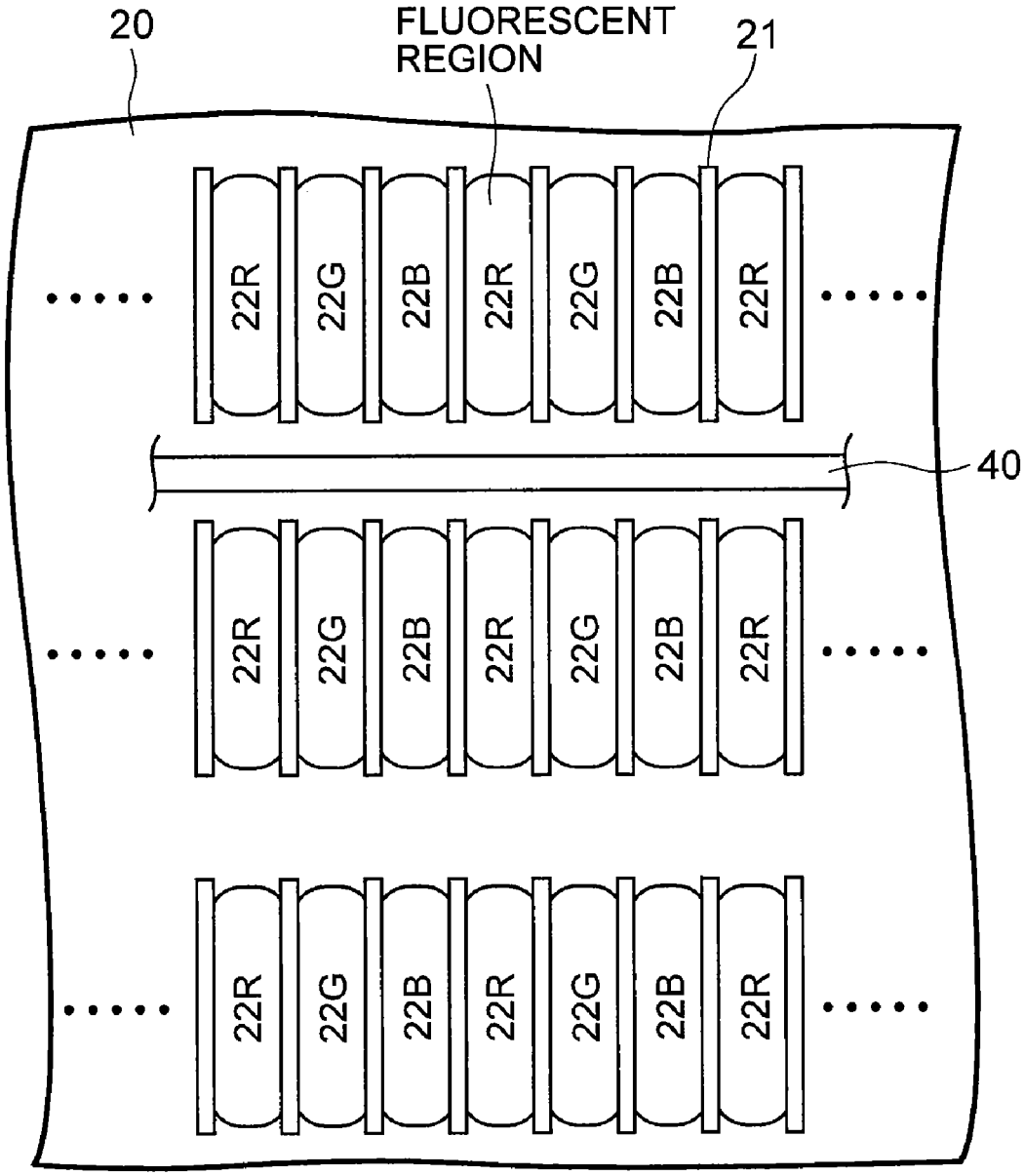
FIG. 8 is a view diagrammatically showing the arrangement of the barrier, spacer, and fluorescent regions in the anode panel constituting the flat-type display device.
Figure 9:
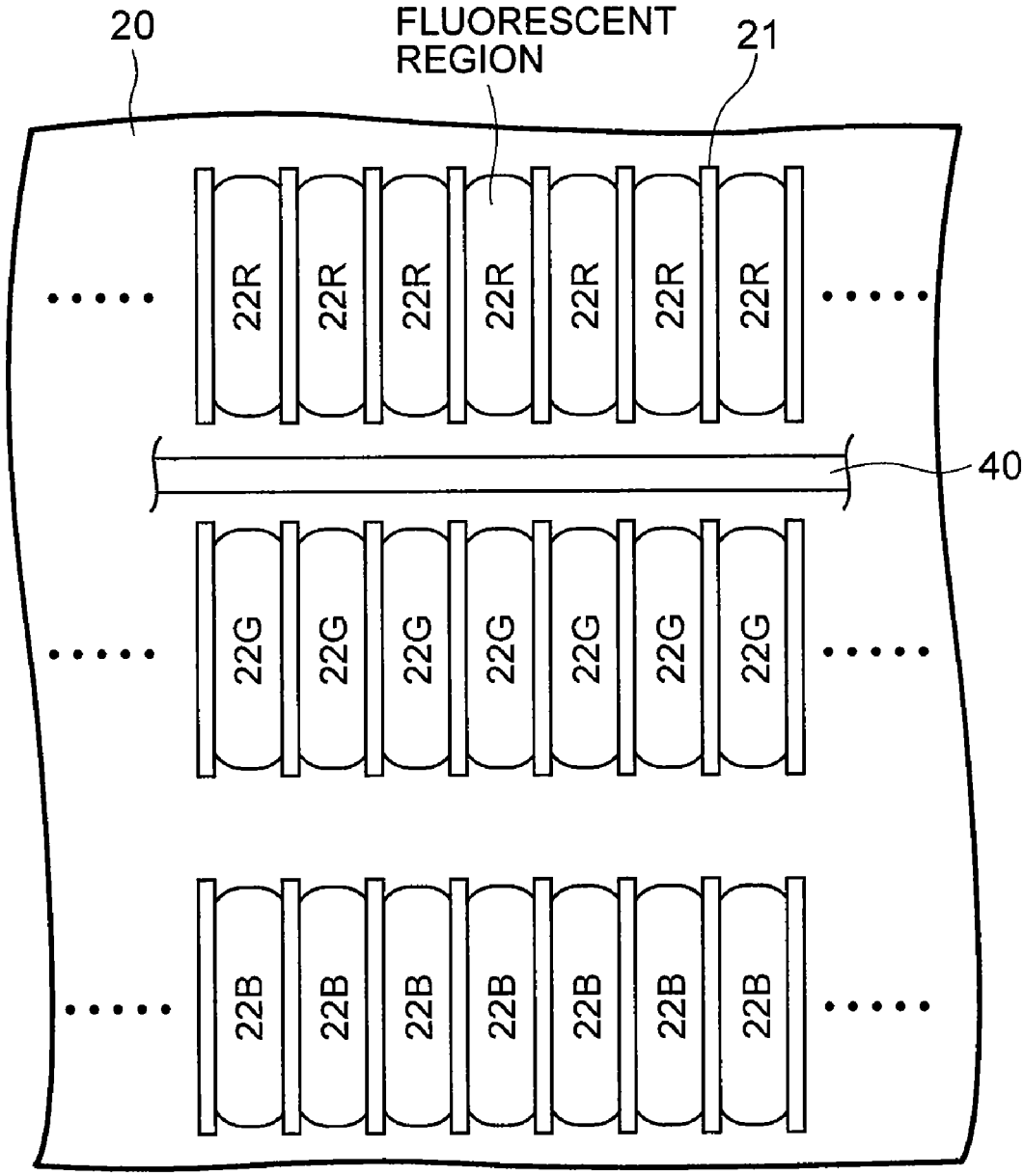
FIG. 9 is a view diagrammatically showing the arrangement of the barrier, spacer, and fluorescent regions in the anode panel constituting the flat-type display device.
Figure 10:
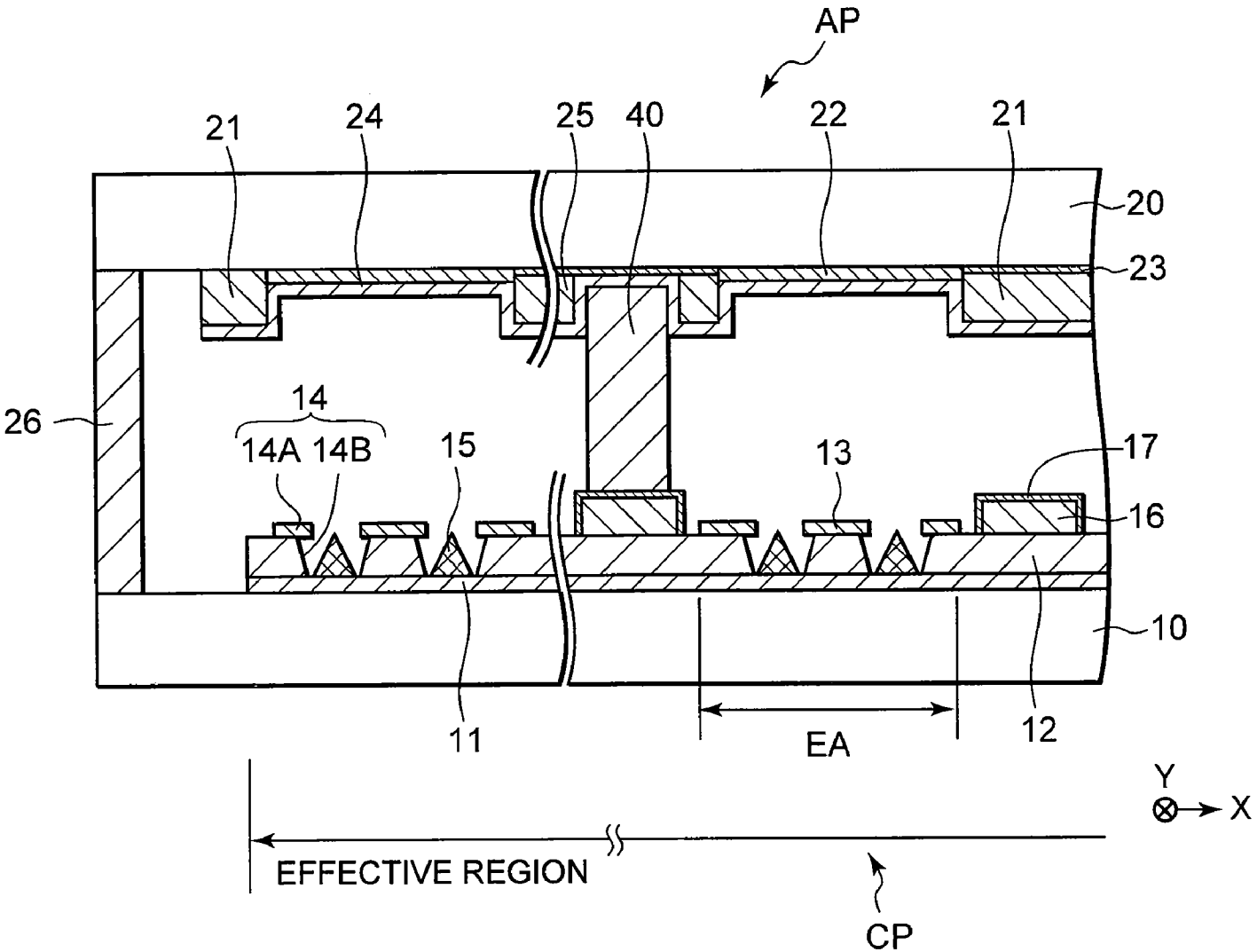
FIG. 10 is a diagrammatic fragmentary end view of a related art flat-type display device having a Spindt-type cold cathode field emitter element.

Examples of arrangements of the barrier 21, the spacer 40, and the fluorescent regions 22 are diagrammatically shown in FIGS. 4 to 9. The arrangements of the fluorescent regions and others in the display devices shown in FIGS. 1 to 3 are shown in FIG. 5 or FIG. 7. In FIGS. 4 to 9, the anode electrode is not shown. Examples of flat forms of the barrier 21 include a lattice-like form (form of parallel crosses), specifically, a form surrounding the four sides of the fluorescent region 22 corresponding to one subpixel and having, for example, a flat form of substantially rectangular form (see FIGS. 4, 5, 6, and 7), and a strip form extending parallel to the opposite two sides of the substantially rectangular (or strip-form) fluorescent region 22 (see FIGS. 8 and 9). In the fluorescent regions 22 shown in FIG. 8, the fluorescent regions 22R, 22G, 22B can be in the form of a strip extending in the vertical direction in FIG. 8. Part of the barrier 21 serves also as a spacer holder 25 for holding the spacer 40.

The anode panel AP in Example 2 or the display device in Example 2 has substantially the same structure and construction as the structure and construction of the anode panel AP in Example 1 or the display device in Example 1, except that the barrier 21 is formed in Example 2, and therefore detailed descriptions of them are omitted.

Herein below, a method for producing the flat-type display device in Example 2 is briefly described.

[Step-200]

A barrier 21 in a lattice-like pattern is first formed on a substrate 20. Specifically, a lead glass layer colored black with a metal oxide, such as cobalt oxide, having a thickness of about 50 μm is formed, and then the lead glass layer is selectively processed by a photolithography technique and an etching technique to form the barrier 21 in a pattern of parallel crosses. Alternatively, a low melting-point glass paste is printed on the substrate 20 by a screen printing process, and then the low melting-point glass paste is calcined to form the barrier 21. Further alternatively, a photosensitive polyimide resin layer is formed on the entire surface of the substrate 20, and then the photosensitive polyimide resin layer is exposed and developed to form the barrier 21. The barrier 21 has opening regions of a size: length×width×height=280 μm×100 μm×60 μm. It is preferable that, prior to formation of the barrier 21, a light absorbing layer (black matrix) 23 composed of, e.g., chromium oxide is formed on the surface of a portion of the substrate 20 where the barrier 21 will be formed.

[Step-210]

Next, fluorescent regions 22 are formed on portions of the substrate 20 surrounded by the barrier 21 in the same manner as in the [step-110] in Example 1.

[Step-220]

Then, a resin layer is formed both on the top surface of the barrier 21 and on the fluorescent regions 22. Specifically, a step substantially similar to the [step-120] in Example 1 is conducted.

[Step-230])

Then, a conductor layer is formed on the entire surface, specifically, on the resin layer, in the same manner as in the [step-130] in Example 1.

[Step-240]

Next, the resin layer is removed by a heat treatment in the same manner as in the [step-140] in Example 1.

[Step-250]

Next, an adhesion improving layer 50 is formed on the entire surface by a sputtering process, and an electron absorbing layer 51 is formed on the adhesion improving layer 50 by a sputtering process in the same manner as in the [step-150] in Example 1, and then a display device is assembled in the same manner as in the [step-160] in Example 1. In Example 2 or below-mentioned Example 3, the adhesion improving layer 50 has a thickness of 50 nm, and the electron absorbing layer 51 has a thickness of 150 nm.

Also in Example 2, on the anode electrode 24 is formed the adhesion improving layer 50 composed of a silicon carbide layer having an average thickness of 200 nm, the adhesion improving layer 50 composed of a layer made of silicon carbide and boron carbide and having an average thickness of 50 nm, or the adhesion improving layer 50 composed of a tungsten carbide layer having an average thickness of 200 nm. Therefore, in the calcination of the bonding layer in a nitrogen gas atmosphere at about 400° C. for 10 to 30 minutes in the [step-160], a problem in that the electron absorbing layer 51 having a thickness of 150 nm was peeled off the adhesion improving layer 50 or a crack was caused in the electron absorbing layer 51 did not occur.

For comparison, in a step similar to the [step-250], the adhesion improving layer 50 was not formed and the electron absorbing layer 51 was directly formed on the anode electrode 24 by a sputtering process to prepare an anode panel, and then a display device was assembled. In the calcination of the bonding layer in a nitrogen gas atmosphere at about 400° C. for 10 to 30 minutes, the electron absorbing layer 51 was disadvantageously peeled off the anode electrode 24.[0110]

EXAMPLE 3

Example 3 is a variation of Example 2. In Example 2, the anode electrode 24, the adhesion improving layer 50, and the electron absorbing layer 51 are formed on the top surface of the barrier 21. On the other hand, as shown in a diagrammatic fragmentary end view of the display device of FIG. 3, in Example 3, the anode electrode covers each fluorescent region and extends to the sidewall of the barrier, but the anode electrode 24 is not formed on the top surface of the barrier 21, and only the adhesion improving layer 50 and the electron absorbing layer 51 are formed on the top surface of the barrier 21. That is, the anode electrode 24 is composed of a plurality of anode electrode units 24A, more specifically, corresponding to subpixels. The adjacent anode electrode units 24A are electrically connected to each other through the adhesion improving layer 50 and the electron absorbing layer 51.

The anode panel AP in Example 3 or the display device in Example 3 has substantially the same structure and construction as the structure and construction of the anode panel AP in Example 1 or the display device in Example 1, except that the barrier 21 is formed and the anode electrode 24 is composed of a plurality of anode electrode units 24A in Example 3, and therefore detailed descriptions of them are omitted.

The anode panel AP in Example 3 can be prepared by removing a portion of the anode electrode on the top surface of the barrier 21 by an appropriate method (e.g., an etching process) between the [step-240] and the [step-250] in Example 2, or forming a conductor layer on the fluorescent regions 22 (or on the fluorescent regions 22 and the sidewall of the barrier 21) in the [step-230] in Example 2 instead of the conductor layer formed on the entire surface.

Above, the embodiments are described with reference to the preferred Examples, which should not be construed as limiting. The constructions and structures of the flat-type display devices, cathode panels, anode panels, cold cathode field emission display devices, and cold cathode field emitter elements described in the Examples are merely examples and can be appropriately changed, and the methods for fabricating the anode panel, cathode panel, cold cathode field emission display device, or cold cathode field emitter element are also merely examples and can be appropriately changed. Further, various materials used in the production of the anode panel or cathode panel are also merely examples and can be appropriately changed. With respect to the display device, color display is generally described as an example, but monochromatic display can be made. If desired, formation of the focusing electrode can be omitted.

The display device may have a construction such that a second adhesion improving layer is formed on the electron absorbing layer and a second electron absorbing layer is formed on the second adhesion improving layer. In this case, the electron absorbing layer and the second electron absorbing layer are not necessarily composed of the same material, and the adhesion improving layer and the second adhesion improving layer are not necessarily composed of the same material.

With respect to the field emitter element, a form in which one electron emitter corresponds to one opening is described above, but, depending on the structure, the field emitter element may have a form in which a plurality of electron emitters correspond to one opening or a form in which one electron emitter corresponds to a plurality of openings. Alternatively, the field emitter element may have a form in which a plurality of first openings are formed in the gate electrode and a second opening in communication with the first openings is formed in the insulating layer and one or a plurality of electron emitters are formed.

The electron emitter areas can be composed of an electron emitter element called surface conductive-type electron emitter element. The surface conductive-type electron emitter element is composed of, on a support made of, e.g., glass, a conductor, such as tin oxide ($SnO_2$), gold (Au), indium oxide ($In_2O_3$)/tin oxide ($SnO_2$), carbon, or palladium oxide (PdO), and a pair of electrodes having a minute area and having a predetermined gap therebetween, which are formed in a matrix form. A carbon thin film is formed on each electrode. The electrodes have a construction such that a horizontal wiring is connected to one of the electrodes and a vertical wiring is connected to another. When a voltage is applied to the electrodes, an electric field is made between the carbon thin films facing each other through a gap, so that electrons are emitted from the carbon thin films. The electrons are permitted to collide with the fluorescent regions on the anode panel, so that the fluorescent regions are excited to emit light, thus obtaining a desired image. Alternatively, the electron emitter areas can be composed of a metal/insulating film/metal element.

In the examples, the adhesion improving layer is formed between the anode electrode and the electron absorbing layer. Therefore, even when the anode panel is adversely affected by heat shrinkage due to heating and cooling or the heating atmosphere in thermal steps, an unfavorable phenomenon such that the electron absorbing layer is partially or completely peeled off the anode electrode or a crack is caused in the electron absorbing layer can be surely prevented. Accordingly, not only can the lowering of the contrast due to backscattering electrons be avoided to improve the color purity, but also the dielectric strength can be improved. Further, problems in that the application of a high voltage to the anode electrode induces discharge, that the reliability of the flat-type display device is lowered, and that the life of the flat-type display device is shortened can be surely avoided.

It should be understood by those skilled in the art that various modifications, combinations, sub-combinations and alterations may occur depending on design requirements and other factors insofar as they are within the scope of the appended claims or the equivalents thereof.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A flat-type display device comprising:

a cathode panel having a plurality of electron emitter areas formed on a support; and an anode panel having formed on a substrate a plurality of fluorescent regions and an anode electrode covering at least the fluorescent regions, in which the cathode panel and the anode panel are joined together at their edges with a joint member in between, wherein the anode panel has formed on the anode electrode an electron absorbing layer for absorbing electrons from any one of the fluorescent regions and the anode electrode or both, and wherein the anode panel has an adhesion improving layer formed between the anode electrode and the electron absorbing layer.

2. The flat-type display device according to claim 1, wherein:

the anode panel has formed on the substrate a barrier in a lattice-like pattern surrounding each fluorescent region, the anode electrode covers each fluorescent region and extends to a sidewall of the barrier, and the adhesion improving layer and the electron absorbing layer are formed on a top surface of the barrier.

3. The flat-type display device according to claim 1, wherein the electron absorbing layer is composed of carbon.

4. The flat-type display device according to claim 1, wherein:

the adhesion improving layer is composed of any one of a silicon carbide layer, a layer composed of silicon carbide and boron carbide, and a tungsten carbide layer.

5. The flat-type display device according to claim 1, wherein the electron absorbing layer is disposed between the anode electrode and the cathode panel.

6. The flat-type display device according to claim 1 further comprising a light absorbing layer formed on the anode electrode, with the anode electrode between the light absorbing layer and the adhesion improving layer.

7. A flat-type display device comprising:

a cathode panel having a plurality of electron emitter areas formed on a support; and an anode panel having formed on a substrate a plurality of fluorescent regions and an anode electrode covering at least the fluorescent regions, in which the cathode panel and the anode panel are joined together at their edges with a joint member in between, wherein the anode panel has formed on the anode electrode an electron absorbing layer disposed between the anode electrode and the cathode panel for absorbing electrons from any one of the fluorescent regions and the anode electrode or both, and wherein the anode panel has:

an adhesion improving layer formed between the anode electrode and the electron absorbing layer and a light absorbing layer formed on the anode electrode, with the anode electrode between the light absorbing layer and the adhesion improving layer.

8. The flat-type display device according to claim 7, wherein the electron absorbing layer is composed of carbon.

9. The flat-type display device according to claim 7, wherein:

the adhesion improving layer is composed of any one of a silicon carbide layer, a layer composed of silicon carbide and boron carbide, and a tungsten carbide layer.

* * * * *